US005102196A

United States Patent [19]

Kaneda et al.

[11] Patent Number: 5,102,196

[45] Date of Patent: Apr. 7, 1992

[54] CHAIR PROVIDED WITH A BACKREST

[75] Inventors: Shinichi Kaneda; Yoichi Suzuki; Takao Sugano, all of Osaka; Masamitu Miyashita, Nagano; Tunetaro Ito, Nagano; Miyoshi Katagiri, Nagano, all of Japan

[73] Assignee: Kokuyo Co., Ltd., Osaka, Japan

[21] Appl. No.: 476,437

[22] PCT Filed: Oct. 24, 1988

[86] PCT No.: PCT/JP88/01080

§ 371 Date: Jun. 6, 1990

§ 102(e) Date: Jun. 6, 1990

[87] PCT Pub. No.: WO90/04343

PCT Pub. Date: May 3, 1990

[51] Int. Cl.[5] ..... A47C 3/12

[52] U.S. Cl. ..... 297/457; 297/301; 297/421

[58] Field of Search ..... 297/218, 219, 421, 444, 297/452, 457

[56] References Cited

U.S. PATENT DOCUMENTS

| | | | |
|---|---|---|---|
| 3,669,499 | 6/1972 | Semplonius et al. | 297/421 X |
| 3,722,954 | 3/1973 | Rey et al. | 297/452 |
| 4,088,367 | 5/1978 | Atkinson et al. | 297/457 |
| 4,744,603 | 5/1988 | Knoblock . | |
| 4,776,633 | 10/1988 | Knoblock et al. | 297/457 X |
| 4,836,609 | 6/1989 | Hill | 297/452 |
| 4,892,356 | 1/1990 | Pittman et al. | 297/457 |

FOREIGN PATENT DOCUMENTS

| | | |
|---|---|---|
| 57-17522 | 4/1982 | Japan . |
| 60-33483 | 8/1985 | Japan . |
| 61-158244 | 10/1986 | Japan . |
| 62-40951 | 3/1987 | Japan . |
| 63-47747 | 3/1988 | Japan . |
| 1339177 | 11/1973 | United Kingdom . |

*Primary Examiner*—Peter R. Brown

*Attorney, Agent, or Firm*—Wegner, Cantor, Mueller & Player

[57] ABSTRACT

A chair provided with a backrest for use in offices, etc., comprising an inner shell (2) and an outer shell (3). Conventional chairs of this type have a problem that there is little freedom in design with respect to strength and flexibility since only the inner shell serves as a structural member. An object of this chair is to increase the freedom. To this end, in the chair of this invention, the outer shell (3) as well as the inner shell (2) are formed as an integral body L-shaped in side view and comprising a seat portion (31) and a backrest portion (32), so that a three-dimensional shell structure is formed. In this chair, various measures are taken to solve the problem caused by the outer shell which is formed into an integral body. First, a fixed shell (6) is adopted for preventing a gap from being formed. Also, to obtain a required resiliency the shells (2, 3) are of such a construction as to allow a positional shift between the shells, and the inner shell (2) is supported by two brackets (118, 119). In order not to make the user feel uneasy upon resilient deformation of the shells, they are so constructed that the brackrest point (d) can be suitably shifted. Moreover, to connect the shells properly claws, (302, 602) of a particular type and inclined bolts (355) are used. Also, to make a mechanism to be provided between the shells (2,3) as compact as possible, the balancing members (101) support a backrest support (104).

36 Claims, 25 Drawing Sheets

CHAIR PROVIDED WITH A BACKREST

TECHNICAL FIELD

This invention relates to a chair provided with a backrest in which an inner shell and an outer shell are combined to form an integral body having a seat combined with a backrest.

BACKGROUND ART

There is known a chair of this type provided with a backrest and comprising an inner shell consisting of a seat portion and a backrest portion formed into an integral body, with an outer shell consisting of a plurality of sections fixed to the under surface and the back surface of the inner shell. In particular, in the conventional chair the outer shell is divided into at least a portion for a backrest to cover the back surface of the inner shell and a portion for a seat to cover the under surface of the seat portion of the inner shell. Particularly, in many of those chairs in which the motion of the seat relative to the leg is complicated, the outer shell for the seat is divided into a plurality of pieces, with a wide gap formed between the pieces. In some of the chairs the outer shell for the seat is fixed to both the inner shell and a supporting unit for supporting the inner shell.

However, with an outer shell divided into a seat portion and a backrest portion, it is difficult to provide the outer shell with a sufficient strength for the whole shell. In particular, the conventional outer shell has a function merely as a cover for covering the back and under surfaces of the inner shell, and the inner shell is so designed as to provide a structural strength of the seat and the backrest. The conventional inner shell is provided with various complex ribs for suppressing deformation and various cutouts for helping deformation, thereby to impart a required strength to each component member. However, there is a limit to imparting different degrees of strength to different parts of the inner shell which is an integral body. This poses a problem that there is little degree of freedom in design.

The primary object of the invention is to solve the above-mentioned problem by forming the seat portion and the backrest portion of the outer shell into an integral body.

Another object of the invention is to solve concrete problems posed by an outer shell formed as an integral body. The problems are as follows:

(1) Outer shells of different shapes are required for accommodating supporting units of different types to be contained between the inner and outer shells, so that a plurality of large dies of different types need be prepared for forming outer shells.

(2) If the outer shell is applied to a chair in which the seat shifts relative to a supporting unit, a wide gap is likely to remain between the outer shell and that portion of the supporting unit which comes out of the shell.

(3) Since the outer shell itself functions as a member which bears a load, it is difficult to provide the backrest itself with a suitable resiliency. In particular, in conventional chairs, the outer shell for a backrest is fixed to the rear surface of the inner shell by engagement of pins with holes each having a claw for preventing the pin from falling off or by means of screws. If such an arrangement is used in the backrest portion of the outer shell of the invention, the flexibility of the backrest is likely to be lost.

(4) With a chair provided with a backrest with little flexibility and without any particular measures, when the backrest is inclined rearwardly, the distance between the reference point of the sitting position which is the center of the load on the seat and the backrest point corresponding to the fifth lumbar vertebra of a person on the seat varies. In particular, in the chair which takes a reference position, even if the backrest point is set to an ideal position, when the backrest is inclined rearwardly by the user with his back against the backrest, the backrest point shifts upwardly relative to the back of the user, so that the user feels uncomfortable. Moreover, when the user repeatedly leans his back against the backrest and raises his back therefrom, the shirt, etc. worn by the user may be lifted up and the lower portion of the shirt is pulled out from his trousers.

(5) To allow proper resilient rearward deformation of the backrest, with both the inner and outer shells being L-shaped in side view, it is desirable that the backrest portion of the outer shell slightly shifts downwardly relative to the backrest portion of the inner shell upon rearward inclination of the backrest. With this arrangement, however, when the backrest is inclined rearwardly, the seat portion of the outer shell is apt to move forwardly relative to the seat portion of the inner shell. Therefore, if bolts are fixed to the outer shell perpendicularly to the outer surface thereof, a bending force acts on the bolts. Such a bending force repeatedly acts on the bolts each time the backrest is inclined, so that a problem arises that the tapped holes are widened to cause the bolts to become loose.

(6) If the inner shell is combined with the outer shell so that they may be displaced relative to each other, such displacement acts somewhere on the shells, so that the outer shell disadvantageously expands outwardly thereby to form a gap between the outer shell and the inner shell or the cushion material. For example, if the backrest is made flexible, with the backrest portion of the outer shell being so arranged as to be shiftable downwardly within a predetermined distance relative to the backrest portion of the inner shell, when the upper portion of the backrest is inclined rearwardly relative to the lower portion thereof, a bordering portion between the backrest portion and the seat portion of the outer shell protrudes rearwardly, so that a gap is likely to be formed in this portion.

(7) In the conventional inner shell at least four corners of the seat portion thereof are fixed to the metallic bracket of a supporting unit, so that the whole structure lacks flexibility. If an outer shell L-shaped in side view is fixed to the inner shell of the above-mentioned construction, its flexibility is further reduced with resulting reduction of the cushioning ability.

(8) In a chair having a seat and a backrest formed into an integral body by connecting an inner shell L-shaped in side view to an outer shell L-shaped in side view, it is difficult to embed a bearing or the like for supporting armrests in the side portions of the seat and the backrest, so that it is difficult to use inverted L-shaped armrests having one end supported on the seat and the other end supported on the backrest.

(9) In conventional chairs, usually a manual controller is mounted on a particular member of the outer shell, and a mechanism to be controlled by the manual controller is provided in a supporting unit. If such an arrangement is adopted in an outer shell of an integral type L-shaped in side view, the manual controller must be detached from the outer shell when the outer shell is removed from the inner shell, so that it not only takes much time to mount the outer shell on or remove it from the inner shell, but also it is impossible to confirm the function of the mechanism by operating the manual controller mounted in place on the outer shell while looking into the mechanism.

10 That portion of the supporting unit which supports the inner shell and a backrest support projecting from the supporting unit must be enclosed in a relatively small space formed between the inner shell and the outer shell. As a result, a problem arises that it is rather difficult to make the backrest support and the supporting unit rigid enough to form a strong structure free from loosening.

DISCLOSURE OF THE INVENTION

The chair provided with a backrest according to the invention comprises an inner shell L-shaped in side view and consisting of a seat portion and a backrest portion, and an outer shell L-shaped in side view and consisting of a seat portion and a backrest portion, and is characterized by providing that the outer shell is fitted to the inner shell without their whole surfaces contacting each other. In this construction, the inner shell and the outer shell make a three-dimensional structure which has a strength enough to keep the combined seat and backrest in good shape. With this arrangement, by selecting a suitable curvature of the inner and outer shells or a suitable distance between the shells or a suitable range of shifting between the shells, it is possible to freely set the strength and flexibility of the component parts to a desired value within a wide range. As compared with the conventional chairs in which only the inner shell takes a role as a structure, the degree of freedom in design and feeling in use such as cushioning characteristic and durability can be increased effectively and without difficulty.

Also, this invention is characterized by providing that the outer shell is supported by the inner shell only. With this arrangement, if only the inner shell hidden inside the chair is provided with spare mounting means for different supporting units of various designs, it is sufficient to provide the outer shell with a single type of mounting device for fixing the outer shell to the inner shell. As a result, even when chairs are manufactured by combining shells with supporting units of various designs, inner and outer shells of a single type suffice without deteriorating their appearance.

This invention is further characterized by providing that a fixed shell is provided at such a position as to close an opening formed in the seat portion of the outer shell and the fixed shell is secured to a supporting unit for supporting the seat portion of the inner shell. This arrangement effectively prevents a space formed between the inner shell and the outer shell from communicating with the outside through a large gap. Even if the seat moves relative to the supporting unit, it is possible to make the gap as small as possible provided that the positional relation between the fixed shell and the outer shell is previously known.

For example, in a chair in which the outer shell moves horizontally and vertically relative to the supporting unit, the gap can always be kept small by making the shapes of the front and rear walls of the fixed shell similar to the loci the front and rear edges of the opening describe as the chair is moved.

In case a fixed shell is provided in a chair having a backrest in which a supporting unit comprises a leg standing on a base and a supporting base fixed to the upper end of the leg, it is preferable to provide the supporting base with more than three pins projecting downwardly to support the inner surface of the fixed shell on the tips of the pins, and to fix one or two points on the middle portion of the fixed shell to the supporting base by means of bolts. With this arrangement, the fixed shell is fixed to the supporting base only at the middle portion thereof, so that it becomes comparatively easy for the peripheral portion of the fixed shell to be resiliently deformed. As a result, if any relative displacement between the fixed shell and the outer shell is caused to occur by accumulation of dimensional errors, the fixed shell and the outer shell comparatively softly contact each other, so that the fixed shell will not tightly contact the outer shell, thereby to increase abrasion or produce abnormal sound.

This invention is also characterized by providing that the backrest portion of the inner shell and the backrest portion of the outer shell are connected adjacent their side edges in such a manner as to allow relative displacement between the shells in upward and downward directions, and the upper portion of the backrest can be resiliently inclined relative to the lower portion thereof by a load caused by a user leaning against the backrest. With this arrangement, when the inner shell and the outer shell are combined into a structure which has a sufficient strength to keep the contour of the chair, it is possible to give a suitable resiliency to the backrest itself.

To connect the inner shell to the outer shell, a plurality of engaging holes may be provided in the backrest portion of the inner shell near the side edges and the upper edge thereof, with a plurality of inward and downward claws integral with and projecting from the backrest portion of the outer shell near the side edges and the upper edge thereof, so that the inward and downward claws engage the inner side edges and the lower side edges, respectively, of the corresponding engaging holes due to the resilient deformation of the shells. With this arrangement only, however, when an unexpected external force is applied to the backrest, the inward claws provided on both sides of the backrest are likely to fall out of the engaging holes. In particular, in order that the user seated in this type of chair may feel his or her back comfortably held by the backrest of the chair, the backrest portions of the inner and outer shells have their right and left side edges curved so as to project forwardly of the middle portions thereof. If a large force acts on the upper portion of such a backrest to cause forward inclination thereof, the outer shell may be deformed forwardly to cause forward bending of the backrest. Then, since the degree of curvature of the outer shell suddenly decreases, the inward claws on both side edges of the outer shell move outwardly so that they are likely to come out of the corresponding engaging holes.

To eliminate the disadvantage, the invention is characterized by providing that in an arrangement for connecting the shells by engaging the inward and downward claws with the engaging holes, the engaging holes formed adjacent both side edges of the backrest portion have their inner side edges made linear, so that the inward claws engaging the inner side edges of the holes can be moved relatively in upward and downward directions, and that tongues deformable in the direction of the thickness thereof are provided so as to project from the outer side edges of the holes, with the free ends of the tongues abutting on the outer surfaces of the inward claws engaging the inner side edges of the holes.

Another way to eliminate the disadvantage is that a plurality of first engaging holes are provided adjacent the upper edge of the backrest portion of the inner shell, and a plurality of downward claws are integrally formed so as to project from the upper edge portion of the backrest portion of the outer shell, and a plurality of second engaging holes extending vertically and comprising a narrower upper half portion and a wider lower half portion are provided adjacent both side edges of the backrest portion of the inner shell, and outward claws comprising a head portion which can be inserted through the lower half portion of the second engaging hole and a base portion thereof tightly engagable with the upper half portions thereof are provided so as to project from the side edge portion of the backrest portion of the outer shell, so that the outward claws are inserted through the lower half portions of the second engaging holes to engage the outer edges of the upper half portions thereof, and the downward claws engage the lower edges of the corresponding first engaging holes through utilization of resilient deformation of the respective members.

In an arrangement that the backrest support is disposed between the inner shell and the outer shell, it is preferable that the upper portion of the inner shell is rearwardly inclinable at a portion near the upper end of the backrest support as a fulcrum.

In a chair of this type, however, since the inner shell is curved so that both the right and left sides thereof project forwardly as previously mentioned, if the middle portion of the inner shell is rigidly fixed to the bracket of the backrest support, the upper half portion thereof is hard to be inclined rearwardly.

Therefore, in accordance with the invention, the backrest portion of the inner shell is curved so that both the right and left side edges thereof protrude forwardly of the middle portion thereof, and near the middle portion thereof slits are formed so as to cross a horizontally extending bracket fixed to the upper end of the backrest support, and the inner shell is fixed to the above-mentioned bracket by fasteners only near the side edge portions thereof. With this arrangement, when a rearward force acts on the upper portion of the backrest, the upper portion of the backrest portion of the inner shell is rearwardly inclined relative to the lower portion thereof while the curvature of the backrest portion with both the right and left side portions protruding forwardly decreases and the middle portion of the backrest portion moves away from the bracket. The reason why the backrest portion of the inner shell can smoothly change its curvature is that the slits provided on the backrest portion so as to cross the horizontally extending bracket can absorb the compression of the members produced as the curvature decreases, and due to the existence of the slits, the backrest portion functions as what is called a leaf spring. Thus, it is easy to give a suitable resiliency to the backrest.

Also, the chair provided with a backrest in accordance with the invention is characterized by providing that the upper portion of the backrest portion of the inner shell can be inclined rearwardly relative to the lower portion thereof, and a resilient connecting belt is provided for connecting the base portion of the above-mentioned backrest portion at which the backrest portion is inclined rearwardly and the rear end of the seat portion of the inner shell, and that portion of the belt which is connected to the backrest portion is curved so as to protrude slightly forwardly, so that when the upper part of the backrest portion is rearwardly inclined relative to the lower part thereof, the curved portion of the connecting belt can protrude forwardly relative to the lower part of the backrest portion. With this arrangement, if a so-called backrest point for supporting a person seated in the chair near the fifth lumbar vertebra thereof is set on the curved portion of the connecting belt, the backrest point shifts downwardly as the curved portion protrudes forwardly while being inclined rearwardly. Therefore, by suitably selecting the curvature of the curved portion and the manner in which the curved portion follows the rearward inclination of the upper portion of the backrest relative to the lower portion thereof, it is possible to freely control the manner of shifting of the backrest point. Thus, it is easy to maintain as constant as possible the distance between the backrest point and the sitting reference point which is the center of a load on the seat. As a result, it is possible to prevent the shirt, etc. worn by the user from being tucked up.

To cause the curved portion to project effectively upon rearward inclination of the upper portion of the backrest, it is desirable to make that portion of the connecting belt which is connected to the backrest portion of the inner shell thicker than the remaining portions thereof, or to provide ribs adjacent thereto for reinforcement. To regulate the curvature of the curved portion, it is preferable to form a portion of the belt below the curved portion into resiliently flexible bellows. In particular, if the bellows have a large resilient traction force, the protrusion of the curved portion is restricted. If the resilient traction force is set to a small value, the curved portion is allowed to protrude to a greater extent.

If two slits are formed extending longitudinally of the inner shell thereby to form a connecting belt between the slits, it is possible to form the connecting belt simultaneously with forming the inner shell, so that it becomes easier to make an inner shell than if a separate connecting belt were attached thereto.

No matter whether or not a connecting belt functioning in the above-mentioned manner is provided, it is advantageous to provide a resin injection port for forming an inner shell at the center thereof, and a pair of slits extending longitudinally of the shell at both the right and left sides of the port. In particular, with this arrangement upon injection molding of an inner shell by using a die, the resin injected into the die through the port is guided by the ridges formed in the die for forming slits so as to flow toward the forward edge of the seat portion and the upper edge of the backrest portion, and a part of the flow passes over the lower and upper ends of the slits to be introduced into both the right and left edge portions of the inner shell. Therefore, the length of the path from the resin injection port to both the front and upper edges and the length of the path from the resin injection port to the right and left side edges become equal, so that there will be little difference in the density of the resin between the areas near the side edges and the areas near the front and upper edges, with a resulting advantage that little deformation will occur and the chair will be hardly cracked or broken after long use.

Suppose that in manufacturing chairs provided with a backrest the upper part of which can be resiliently inclined rearwardly relative to the lower part thereof while allowing displacement of the shells relative to each other, standard products are given a suitable resiliency against rearward inclination of the backrest. Then, if high-grade products having a longer backrest because of a pillow attached thereto are made by using an inner and an outer shell of a type common with those used in the above-mentioned standard products, the backrest may lack resiliency in some cases. To eliminate the disadvantage, according to this invention a resilient plate-like member extending upwardly from the tip end of the backrest support is provided so as to resiliently support the rear surface of the inner shell. With this arrangement, even if common inner and outer shells are used for standard and high-grade products, by using a suitable resilient plate-like member it is possible to set the repellent force against rearward inclination of the backrest to a required value.

However, even if the curved portion of the connecting belt is so designed as to protrude forwardly relative to the lower part of the backrest as described above, when the upper part thereof is inclined rearwardly relative to the lower part thereof, a thick pad in high-grade chairs would absorb such protrusion of the curved portion, so that the backrest point could not be effectively shifted downwardly. Therefore, in accordance of the invention, a resilient plate-like member is pivotally mounted near the lower end thereof on the upper end of the backrest support, with the upper portion of the resilient plate-like member above the pivot bearing against the upper rear surface of the inner shell, so that when the upper part of the inner shell is inclined rearwardly, the lower end portion of the resilient plate-like member protrudes forwardly thereby to urge forwardly the pad covering the surface of the inner shell. With this arrangement, the pad near the lower end portion of the resilient plate-like member is pushed forwardly, so that the backrest point moves substantially downwardly.

The invention also provides a chair provided with a backrest comprising an inner shell and an outer shell both L-shaped in side view, and characterized by providing that on the under surface of the seat portion of the inner shell there are provided a plurality of pins projecting in parallel with each other and perpendicularly to an imaginary plane extending between the front edge of the seat and the upper edge of the backrest, and on the upper surface of the seat portion of the outer shell there are provided at those positions which correspond to the above-mentioned pins a plurality of hollow cylindrical projections extending in axial alignment with the above-mentioned pins, so that the outer shell is connected to the inner shell by inserting each of the pins into the corresponding one of the hollow cylindrical projections, and the outer shell is fixed to the inner shell by means of bolts screwed therethrough in a direction axially aligned or parallel with the axes of the pins. With this arrangement, when the seat portion of the outer shell is shifted forwardly relative to the seat portion of the inner shell upon rearward inclination of the backrest, the movement causes the engagement of the pins with the hollow cylindrical projections to become more tight. As a result, an axial force only acts on the bolts which connect the seat portion of the outer shell to the seat portion of the inner shell, thereby to prevent a bending moment from repeatedly acting on the bolts to widen the threaded holes thereby to loosen the bolts. With this arrangement, by only placing on an inner shell placed upside down stably on a working table an outer shell from immediately above the inner shell, it is possible to engage the pins on the inner shell with the hollow cylindrical projections on the outer shell. Since the axes of the bolts coincide with those of the pins and the hollow cylindrical projections when they engage each other, they all are positioned in parallel. As a result, it is easy to simultaneously fix all the bolts to the required positions by means of a multi-screw fastener having parallel drivers which are driven simultaneously.

The invention is further characterized by the provision of a projection upwardly aslant at least on the front edge of the seat portion of the inner shell. With this arrangement, the projection is pushed into the lower front edge portion of the pad, so that the projection prevents the pad from sliding on the upper surface of the inner shell. In this case, with the projection directed upwardly aslant, when a rearwardly directed force acts on the front edge of the pad, the projection is pushed into the under surface of the pad, so that a securer engagement of the pad and the projection is obtained.

Also, the invention is characterized by providing that a continuous brim extending downwardly and rearwardly is formed on the peripheral edge of the inner shell, and a continuous brim extending upwardly and forwardly is formed on the peripheral edge of the outer shell, with the brim on the outer shell being positioned inside and substantially parallel with the brim on the inner shell. With this arrangement, even if the outer shell is deformed to expand outwardly, the brim on the outer shell and the brim on the inner shell shift relative to each other with their surfaces in sliding contact, so that if the brims are made of a suitable height, no gap will be formed between the shells. If there is a dimensional error in the outer shell itself or an unexpected deformation such as curving occurs to the shell, the brims overlapping each other cooperate to prevent a gap from being produced. If the peripheral portion of the upholstery is passed between the brims and fixed to the inner shell, it is possible to completely prevent the fixed points from being exposed outside. When the backrest is rearwardly inclined, especially the border portion of the seat portion and the backrest portion of the outer shell is likely to protrude outwardly. In the chair of the invention, however, since the extension dimension of the brim of the inner shell in the border portion between the seat and the backrest is greater than that in the other areas, even if deformation of the outer shell is concentrated on the boarder portion, it is possible to effectively prevent any gap from being produced.

The invention is further characterized by providing that the seat portion of the inner shell is fixed to a seat bracket on the supporting unit for supporting the seat, and the backrest portion of the inner shell is fixed to a backrest bracket provided on the backrest support extending from the supporting unit, and between the brackets the inner shell is not fixed to the supporting unit. With this arrangement, the degree to which the inner shell is restrained by the supporting base and the backrest support can be minimized, so that a soft supporting mechanism like a hammock can be obtained. A good cushioning characteristic can be obtained even with an outer shell L-shaped in side view connected to the inner shell.

The chair of the invention in which the inner shell is supported by the above-mentioned seat and backrest bracket is characterized by providing that a shaft is provided on each of the opposite ends of each of the brackets so as to project sideways, and a bearing is embedded in each of the opposite ends of resiliently deformable inverted L-shaped armrests, so that the bearings in the front ends of the armrests are supported by the shafts on the seat brackets, and the bearings in the rear ends of the armrests are supported by the shafts on the backrest brackets. With this arrangement, it is not necessary to provide in the seat or the backrest any bearings or means for preventing the shafts from falling out of the bearings. In this arrangement, if a circumferential engaging groove is formed on each of the shafts on the brackets, and a radial threaded hole is formed in each of the bearings embedded in the opposite ends of the armrests, and an engaging bolt is screwed into the threaded hole so that the tip end thereof engages the circumferential groove of each of the above-mentioned shafts, the armrests can be fixed to the required positions without fail, and it is possible to attach the armrests to or detach them from the chair easily from outside.

In case such inverted L-shaped armrests are used, the armrests may be C-shaped in cross section, and the seat bracket and the backrest bracket may be urged toward each other by the resiliency of the armrests. This arrangement makes it possible for the armrests to function as a spring for self-restoration of the backrest from a rest position to a reference position. As a result, it is possible to use a small spring for urging the backrest provided between the inner shell and the outer shell, or to dispense with such a spring.

The invention is further characterized by providing that the outer shell is detachably mounted on the inner shell, and a fixed shell is detachably fixed to the supporting unit, and a manual controller and a mechanism to be operated by the manual controller are provided on the inner shell and the supporting unit independently of the outer shell and the fixed shell. With this arrangement, when the outer shell and the fixed shell are detached from the inner shell and the supporting base, it is not necessary at all to detach the manual controller from these shells. Even if the outer shell and the fixed shell are detached so as to enable looking into the mechanism, the manual controller remains fixed at the regular position, so that it is possible to confirm the function of the manual controller in the same condition as in the normal operation of the manual controller, and to adjust the operation if necessary. In case the mechanism is provided in the supporting base, and the manual controller is provided outside the supporting base, with a transmission wire comprising a wire core slidably passing through a guide tube being used for transmitting an operation applied to the manual controller to the mechanism, it is preferable that one end of the guide tube is held on the supporting base in such a manner that it is not possible to adjust the position while the other end of the guide tube is held on the under surface of the inner shell outside the supporting base in such a manner as to enable adjustment of the fixed position. In this manner it is possible to make the construction simpler than if both ends of the guide tube are fixed to the supporting base in such a manner as to enable adjustment of the fixed position, and also to prevent the adjusting operation from becoming complex.

The chair provided with a backrest of the invention comprising a combination of an inner shell and an outer shell both L-shaped in side view is also characterized by that the middle portions of the balancing members, from the rear ends of which extends a backrest support for supporting the backrest portion of the inner shell, are pivotally mounted on the supporting base by means of a middle shaft, and the front ends of the balancing members are connected to the front end portion of a seat receiving frame supporting the seat portion of the inner shell by means of front link members pivotally mounted on the supporting base while the rear end portion of the seat receiving frame is connected to the rear ends of the balancing members by means of rear link members so as to be movable forwardly and rearwardly, so that an upward movement of the front end portions of the balancing members upon rearward inclination of the backrest can be translated into a forward movement of the seat receiving frame through the front link members. With this arrangement, when a user leans against the backrest, the seat is forwardly shifted while the backrest is rearwardly inclined. As a result, the user can be shifted to a rest position in stable condition without excessive rearward shifting of his center of gravity. Since the pivot of the backrest support is positioned at the pivot of the balancing members disposed under the seat, upon rearward inclination of the backrest that portion of the backrest support which is included in the backrest is rearwardly inclined as it is rearwardly shifted as a whole. In particular, the backrest support never experiences pivotal motion about a middle point of the backrest as a fulcrum. Therefore, the backrest support can be enclosed between the inner shellL-shaped in side view and the outer shell L-shaped in side view without any trouble.

Since the balancing members and the backrest support are enclosed between the inner shell and the outer shell as described above, it is necessary that they have a required rigidity without becoming bulky and can be operated or stopped surely without rattling or shaking.

To this end, in accordance with the invention, the right and left balancing members as previously mentioned are used in pair, and the seat receiving frame is made of a frame member extending in forward and rearward directions, and a boss having a required axial length is formed on at least one of the upper and lower ends of each of the rear link members, and the rear link members are connected to the seat receiving frame by a shaft passing through the upper ends of the rear link members and to the balancing members by a shaft passing through the lower ends thereof. With this arrangement, the pair of right and left balancing members can always be operated simultaneously by connecting only the end portions of both the balancing members by means of a relatively small connecting member. In particular, when both the balancing members are moved in different directions due to an unexpected external force acting on the backrest or the seat, the motion is translated into a motion for rotating the seat receiving frame horizontally through the right and left front link members. The rear link members connecting the rear end of the seat receiving frame to the balancing members, however, cannot be inclined sideways due to the bosses provided on the lower end portions and/or the upper end portions thereof. In particular, if the link members are made of a mere plate, a clearance formed between the members and the shaft allows the link members to be inclined for a relatively large angle to the right or left. On the contrary, the inclination of the rear link members having a boss to the right or left is greatly restricted even if a clearance for allowing rotation exists between the members and the shaft. As a result, if the seat receiving frame is of a shape hard to be deformed, it cannot turn horizontally. For this reason, both the right and left balancing members can hardly move in different manners. Therefore, the structure can strongly resist the above-mentioned unexpected external force.

For a similar purpose the chair of the invention is so designed that the balancing members are provided in their front end portions with a slot extending longitudinally, which a pin projecting from each of the front link members slidably engages, so that by causing the pin to abut on the front edge of the slot further forward movement of the backrest and further rearward movement of the sat are prevented. With this arrangement, without a particular stopper it is possible to stop the seat and the backrest at the reference position without fail and without rattling or shaking. In particular, the front end edge of the slot of each of the balancing members is engaged by the pin on each of the front link members, so that the front end of each of the balancing members cannot be shifted further downwardly, thereby to prevent both further forward movement of the backrest and further rearward movement of the seat. At this time, since the above-mentioned pins are positioned to engage the ends of the slots, even if there exists some clearance between the inner side surface of each of the slots and the outer circumferential surface of each of the pins, the pins urged against the front ends of the slots cannot be shifted widthwise of the slots. Therefore, there will be no shaking of either the seat or the backrest.

In the above arrangement for engagement, if it is desired to change the postion of engagement, the front link members may be rotatably supported on the eccentric portions of a shaft received by the supporting base, and the fixed position in the direction of rotation may be made adjustable by means of an eccentric position adjusting mechanism.

The invention is further characterized by providing that the bottom wall of the supporting base extends to the vicinity of the rear ends of the balancing members, and a shaft fixed to the rear ends of the balancing members is positioned adjacent the extension of the supporting base, so that the shaft abuts on the extension of the supporting base, thereby to prevent further rearward rotation of the backrest and further forward movement of the seat. With this arrangement, it is not necessary to provide a special stopper for stopping further rearward inclination and further forward movement of the backrest in rest position. If it is desired to control the stopped position of the backrest and the seat at rest position, a threaded hole may be formed piercing nearly perpendicularly through the extension, with a bolt having a grip at the bottom end thereof engaging the threaded hole, so that the above-mentioned shaft may be stopped by the tip end of the bolt.

The invention also provided a chair provided with a backrest and having the above-mentioned balancing members, and characterized by that a middle shaft supporting the balancing members is used also as a shaft for supporting a rotatable arm in a height adjusting mechanism. The arrangement can surely reduce the number of component parts as compared with the arrangement that a middle shaft supporting the balancing members and a shaft for supporting the rotatable arm of the height adjusting mechanism are provided, so that the construction becomes simple and compact, and advantageously provides a space for accommodating the balancing members, etc. between the inner shell and the outer shell.

The invention is further characterized by providing that the backrest support extending from the supporting unit is composed of a pair of solid square metallic bars laterally spaced apart from each other, and the ends of the bars are connected by a connecting member welded thereto, and a bracket having a bent portion is attached to the end surfaces of the solid square bars, with at least three sides of the top end surface of each of the solid square bars being attached to the under surface of the bent portion by welding. With this arrangement, a frame body is formed by the pair of solid square bars, the connecting member and the bracket connected by welding. This provides a high rigidity against falling of the backrest to the left or right side. Moreover, since the top end surfaces of the right and left solid square bars abut on the bent portion of the bracket, with the three sides of the surfaces being fixed to the bent portion by welding, the bars are seldom twisted separately unless a deformation is caused to occur to the bent portion. Therefore, the structure presents a high rigidity aganist a torsional force applied to the whole backrest. As a result, a rigid compact backrest support can be obtained, which is suitable for being placed between the inner shell and the outer shell.

BRIEF DESCRIPTION OF THE DRAWINGS

FIG. 1 is a partially cut out side view;

FIG. 2 is a schemaitc cross-sectional side view showing the interior thereof;

FIG. 3 is a partially omitted cross-sectional plan view;

FIG. 4 is a partial cross-sectional side view showing the interior thereof enlarged;

FIG. 5 is a perspective view showing the supporting unit;

FIG. 6 is a perspective view showing the seat receiving frame;

FIG. 7 is a side view showing the rear link member;

FIG. 8 is a cross-sectional view taken along line I—I in FIG. 7;

FIGS. 9 and 10 show the main portion of the supporting unit for explanation of its operation;

FIG. 11 is a perspective view of the upper end portion of the backrest support as viewed from the rear side thereof;

FIG. 12 is a cross-sectional view showing the end portion of the backrest support;

FIG. 13 is a perspective view of the shells shown separated from each other;

FIG. 14 is a perspective view showing the belt member of the inner shell enlarged;

FIG. 15 is a view for explanation of the operation of the belt member;

FIG. 16 is a cross-sectional view showing the seat portion of the inner shell and the seat portion of the outer shell;

FIG. 17 is an enlarged view of the upward claw;

FIG. 18 is a cross sectional view taken along line II—II in FIG. 17;

FIG. 19 is an enlarged view of the first inward claw;

FIG. 20 is a cross-sectional view taken along line III—III in FIG. 19;

FIG. 21 is a view for explanation of the operation of the device shown in FIG. 20;

FIG. 22 is an enlarged view of the second inward claw;

FIG. 23 is a cross-sectional view taken along line IV—IV in FIG. 22;

FIG. 24 is an enlarged view of the downward claw;

FIG. 25 is a cross-sectional view taken along line V—V in FIG. 24;

FIG. 26 is a view for explanation of the operation of the device shown in FIG. 25;

FIG. 27 is a schematic cross-sectional side view of the inner shell and the outer shell;

FIG. 28 is a partial cross-sectional view showing the side edge portion of the seat;

FIG. 29 is a partial cross-sectional view showing the side edge portion of the border portion between the seat and the backrest;

FIG. 30 is a partial cross-sectional view showing the side edge portion of the backrest;

FIGS. 31 and 32 are explanatory views showing the relation between the outer shell and the legs;

FIG. 33 is a partial exploded view illustrating the connection between the base and the fixed shelf for closing the opening of the outer shelf.

FIG. 34 is a cross-sectional view taken along line VI—VI in FIG. 33;

FIG. 35 is a cross-sectional view taken along line VII—VII in FIG. 33;

FIG. 36 is an exploded perspective view showing the fixed portions of the armrest;

FIG. 37 is a cross-sectional view showing the fixed portion of the armrest to the backrest;

FIG. 38 is a cross-sectional view showing the fixed portion of the armrest to the seat;

FIGS. 39, 40 and 41 are exploded perspective views showing the inner end portion of the transmission wire;

FIG. 42 is a side view showing the front end portion of the supporting base;

FIG. 43 is a cross-sectional view taken along line VIII—VIII in FIG. 42;

FIG. 44 is a cross-sectional view taken along line IX—IX in FIG. 43;

FIG. 45 is a partial cross-sectional view showing the extension of the bottom wall of the supporting base;

FIG. 46 is a front view showing the backrest portions of the inner and outer shells;

FIGS. 47 and 48 are explanatory views showing the side edge portions of the shells, respectively, on an enlarged scale;

FIGS. 49 and 50 are cross-sectional side views showing the backrest portions of the inner and outer shells, respectively; and FIGS. 51 and 52 are cross-sectional views showing the middle height portions of the inner and outer shells, respectively.

BEST MODES OF EMBODYING THE INVENTION

This invention will be described in more detail with reference to the accompanying drawings.

Figure 1:
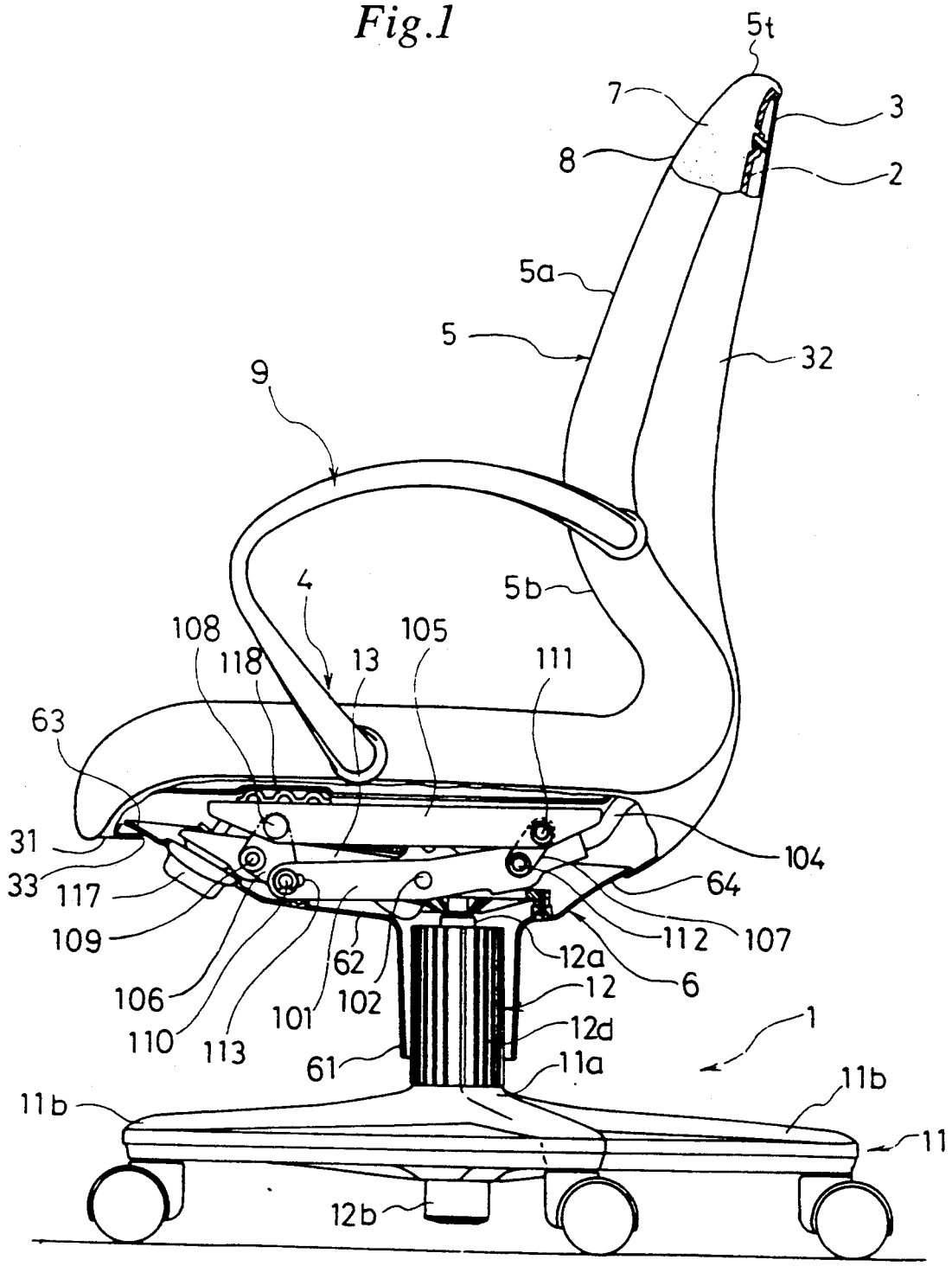
FIGS. 1 to 38 show one embodiment of the invention.

As shown in FIG. 1, the chair provided with a backrest comprises a seat 4 and a backrest 5 integrally composed of an inner shell 2 and an outer shell 3 on a supporting unit 1.

Figure 2:
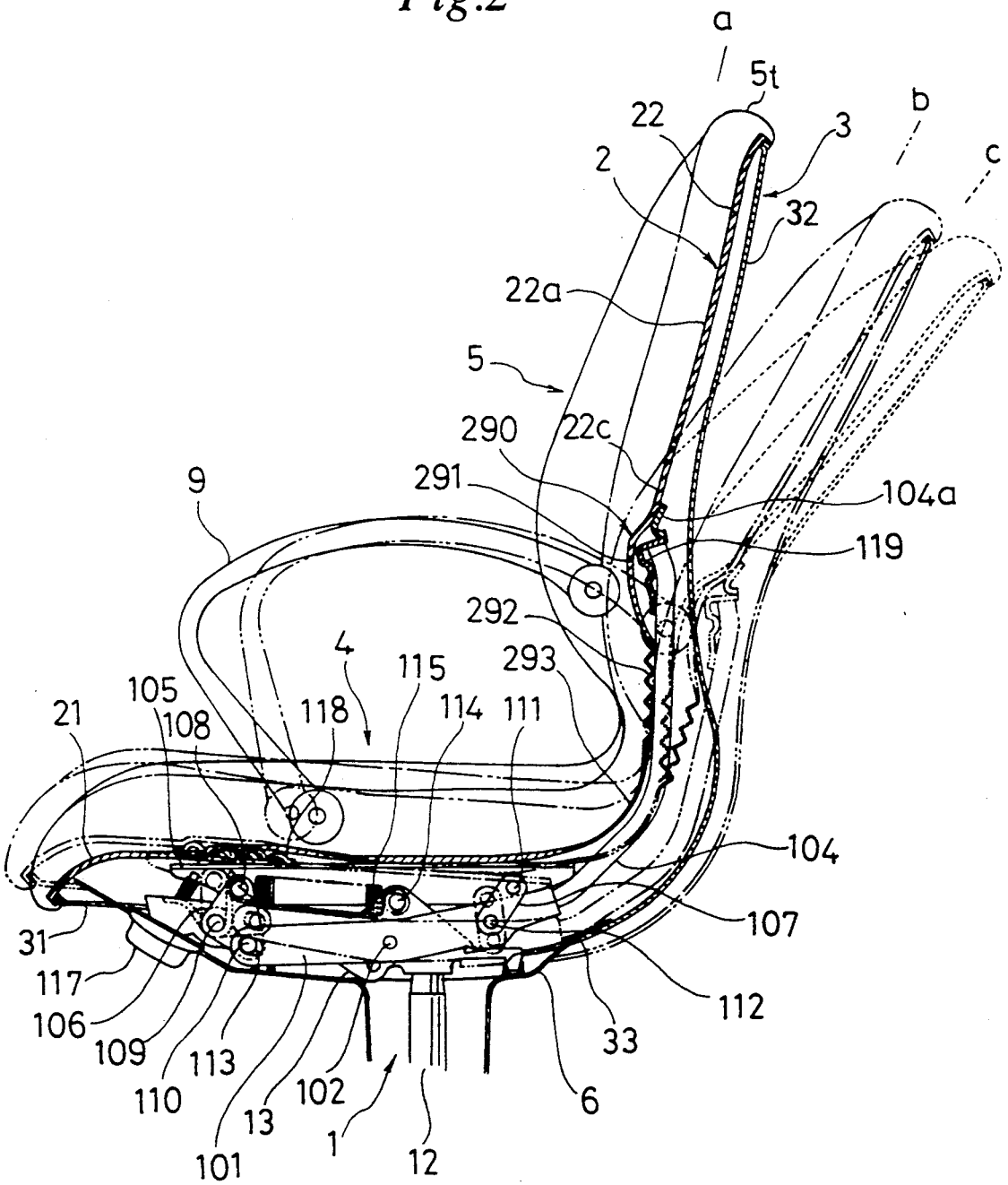
Figure 3:
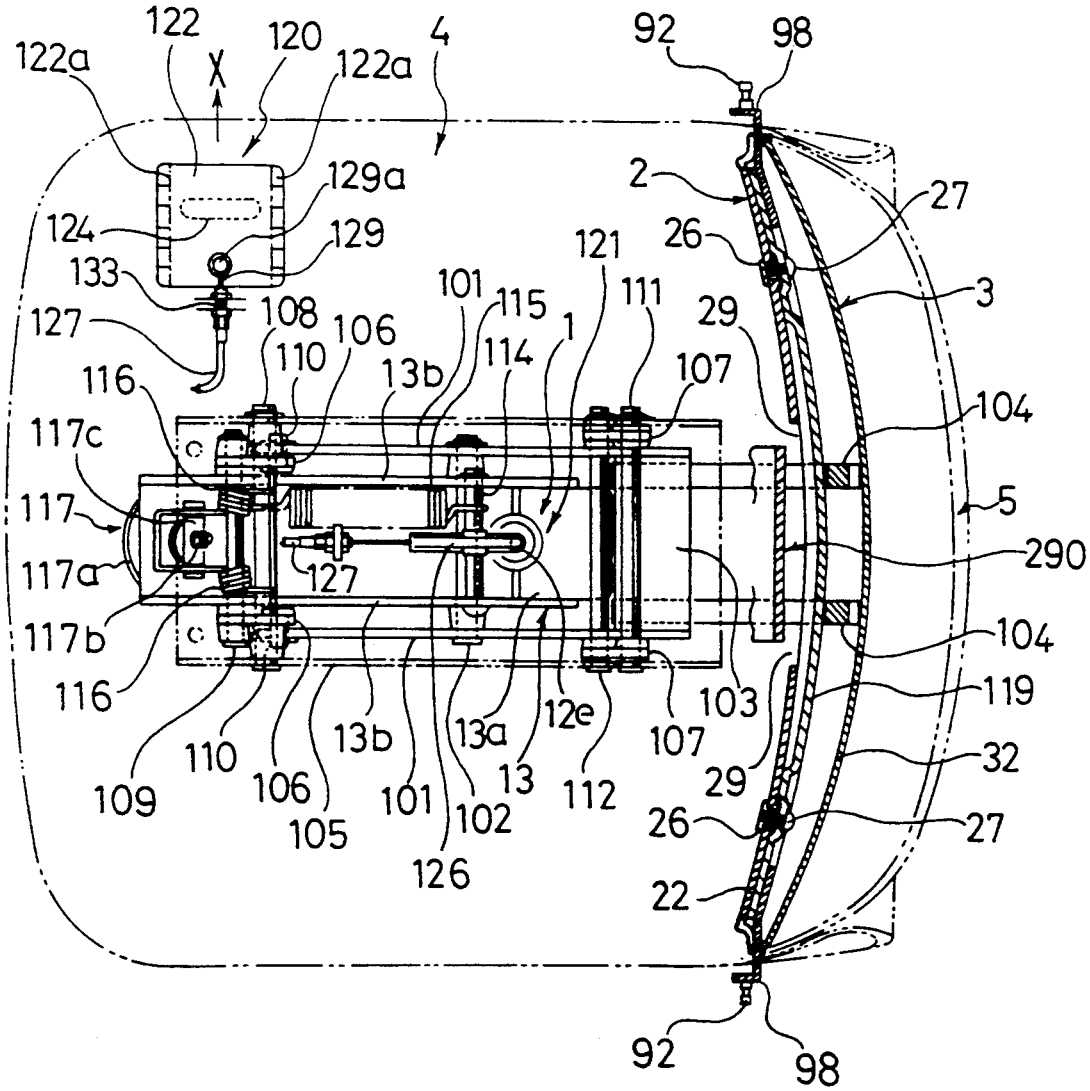
Figure 4:
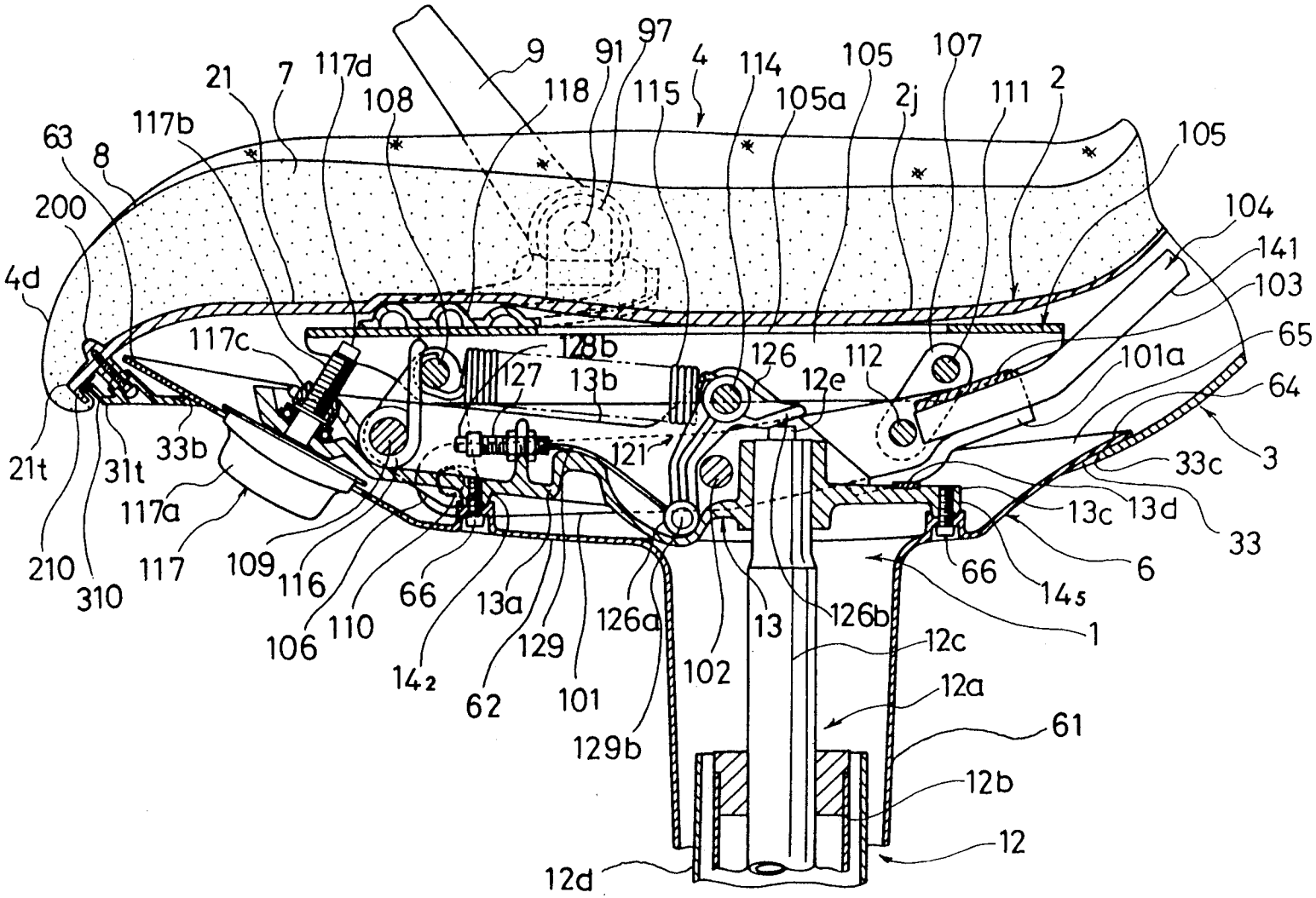
Figure 5:
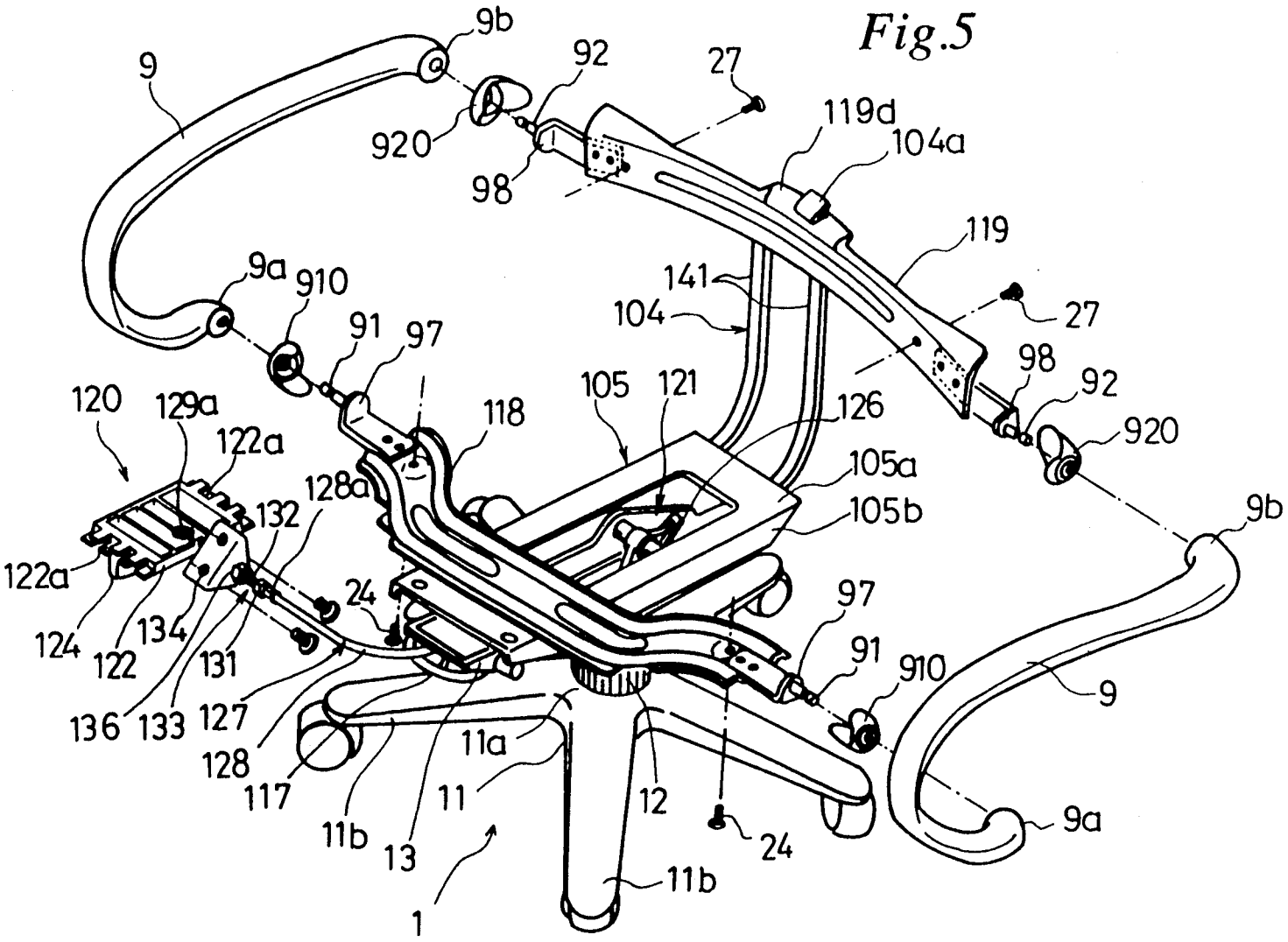
Figure 6:
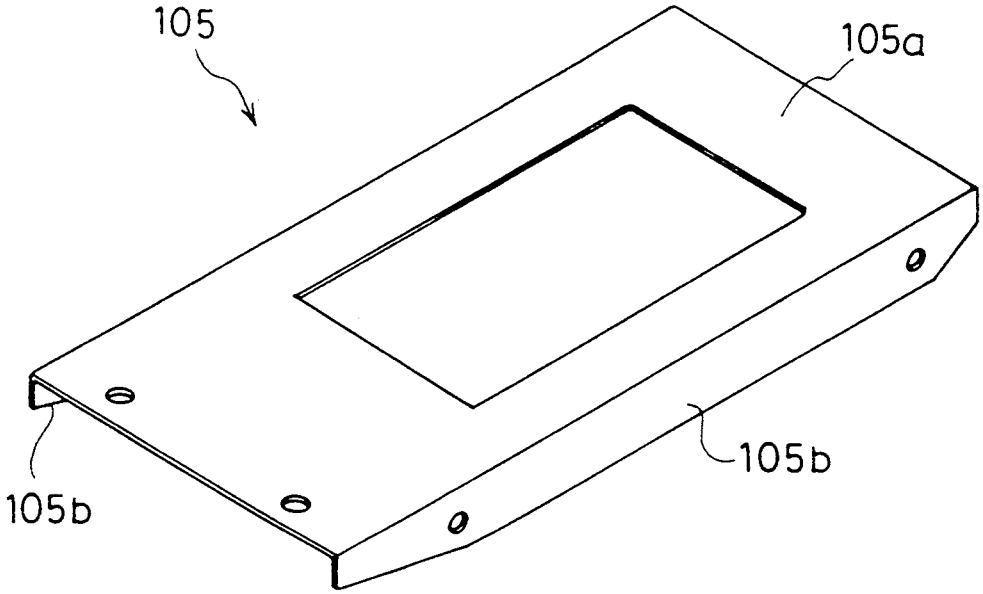
Figure 7:
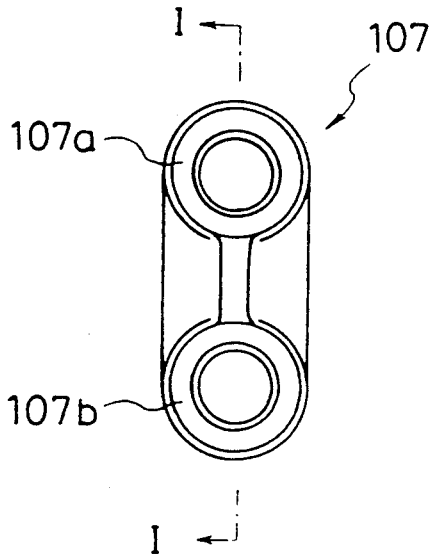
Figure 8:
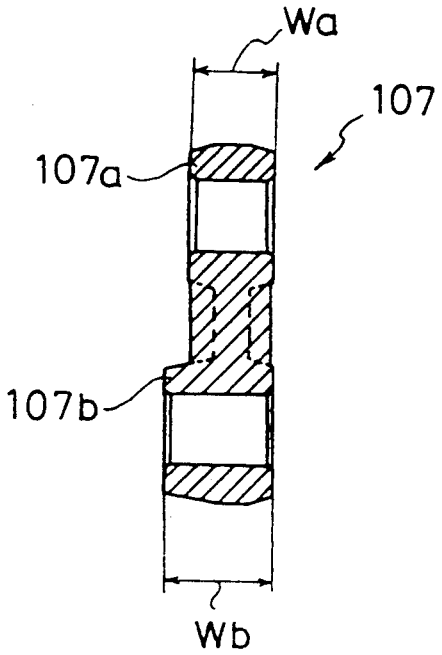
Figure 9:
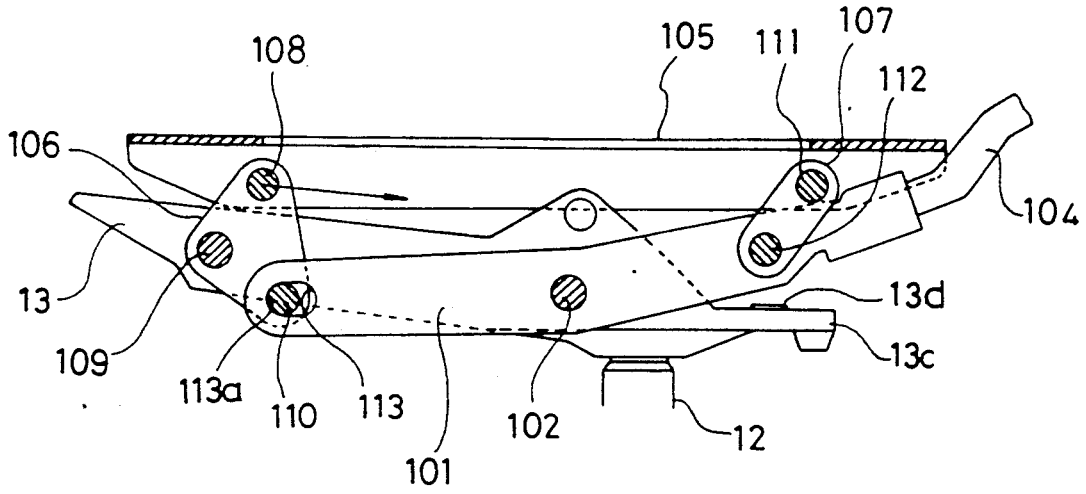
Figure 10:
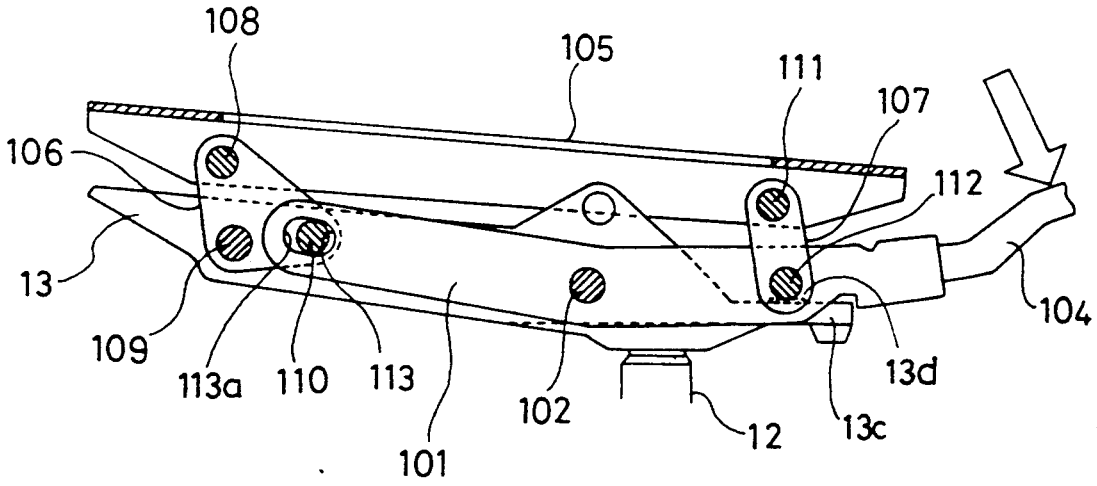

As shown in FIGS. 1 and 5, the supporting unit 1 is provided with a base 11 having five legs 11*b* radially projecting from the circumference of a central boss 11*a*, a column 12 standing on the central boss 11*a* of the base 11, and a supporting base 13 provided on the upper end of the column 12. As shown in FIG. 4, the column 12 comprises a fixed outer tube 12*b* of a gas spring 12*a* connected to the central boss 11*a* of the above-mentioned base 11 through a tapered connecting portion, with the upper end portion of an operating stem 12*c* of the gas spring 12*a* connected to the above-mentioned supporting base 13 through a tapered connecting portion, and a hollow cylindrical cover 12*d* provided outside the fixed outer tube 12*b*. In case the base 11 is made of synthetic resin as an integral body, it is preferable to interpose antislipping means such as an adhesive between the inner circumferential surface of the central boss 11*a* and the outer circumferential surface of the fixed outer tube 12*b*, thereby to prevent the column 12 from lowering due to creeping deformation of the base 11. The gas spring 12*a* is a conventional one such that the locked position is vertically adjustable by opening a built-in valve by pushing an operating rod 12*e* projecting from the upper end of the operating stem 12*c*. The supporting base 13 is made of aluminium by die casting and, as shown in FIGS. 2, 3 and 4, provided with a bottom wall 13*a* extending in forward and rearward directions and having the tapered portion connected to the operating stem 12*c*, and a pair of side walls 13*b* standing on the right and left side edges of the bottom wall 13*a*. A pair of balancing members 101 are pivotally supported on both the side walls 13*b* of the supporting base 13. The balancing members 101 comprise a rectangular plate extending longitudinally and have their central portions pivotally mounted on the above-mentioned supporting base 13 by a shaft 102. The rear ends of the right and left balancing members 101 are rigidly connected to each other by a connecting member 103, with a backrest support 104 upwardly extending from the connected portion. A seat receiving frame 105 is provided on the supporting base 13. As shown in FIGS. 1, 2, 5 and 6, the seat receiving frame 105 is provided with a frame-like top plate 105*a*, and a pair of side plates 105*b* depending from both right and left sides of the top plate 105*a*. The front end portions of both side plates 105*b* are connected to the front ends of the side walls 13*b* of the above-mentioned supporting base 13 through a front link member 106, and the rear end portions of both side plates 105*b* are connected to the rear end portions of both balancing members 101 through a rear link member 107. In particular, the upper pivot ends of the right and left front link members 106 are pivotally connected to the front ends of both side plates 105*b* by a shaft 108, and the lower pivot ends of both front link members 106 are pivotally connected to the side walls 13*b* of the supporting base 13 by a shaft 109. Also, the upper pivot ends of the right and left rear link members 107 are pivotally connected by a shaft 111 to the rear ends of both side plates 105*b* of the seat receiving frame 105, and the lower pivot ends of the rear link members 107 are pivotally connected by a shaft 112 to the rear ends of the balancing members 101. As shown in FIGS. 7 and 8, the upper and lower end portions of the rear link members 107 are provided with bosses 107*a* and 107*b* having respective required axial lengths Wa and Wb. Shafts 111 and 112 are inserted through the bosses 107*a* and 107*b*, respectively. As shown in FIG. 9, the bottom wall 13*a* of the supporting base 13 extends near the rear ends of the balancing members 101, and a shaft 112 fixed to the rear ends of the balancing members 101 is disposed above the upper surface of the extending portion 13*c* of the supporting base 13. As shown in FIG. 10, when the shaft 112 abuts on the extending portion 13*c*, further inclination of the backrest 5 and further forward movement of the seat 4 are prevented. In this embodiment, the extending portion 13*c* of the supporting base 13 has a cushion 13*d* for resiliently receiving the shaft 112 on the upper surface thereof. Both the balancing members 101 are provided in the front end portions thereof with an elongated slot 113 extending lengthwise. A pin 110 provided at the rear pivot point of each of the front link members 106 slidably and rotatably engages the slot 113. The position and size of the slot 113 are set so that the pin 110 abuts on the front end of the slot 113 at the reference position a as shown in real line in FIG. 2 and FIG. 9. In particular, by causing the pin 110 to abut on the front end 113*a* of the slot 113 as shown in FIG. 9, further forward inclination of the backrest 5 and further rearward movement of the seat 4 are prevented. A middle shaft 114 is mounted on the middle parts of the side walls of the above-mentioned supporting base 13, and a main spring 115 is provided between the middle shaft 114 and the shaft 108 to resiliently urge the seat receiving frame 105 rearwardly. An auxiliary spring 116 is wound on the shaft 109 so as to urge the seat receiving frame 105 in the same direction. One end of the auxiliary spring 116 engages spring force adjusting means 117. By changing the engaging position it is possible to adjust the spring force of the auxiliary spring 116. As shown in FIGS. 3 and 4, the spring force adjusting means 117 comprises an adjusting screw 117*b* having a knob 117*a* and a nut 117*c* screwed to the screw and holding one end of the auxiliary spring 116. By rotating the knob 117*a* to move the nut 117*c* forwardly or rearwardly, it is possible to change the spring force. The forward end portion 117*d* of the screw 117*b* is not threaded but is reduced in diameter so that if the nut 117*c* is excessively raised, the adjusting screw 117*b* is rendered idle.

As shown in FIG. 5, a seat bracket 118 and a backrest bracket 119 are fixed to the front end portion of the seat receiving frame 105 and the upper end of the backrest support 104, respectively, and the inner shell 2 is mounted on both the brackets 118 and 119. At the middle portion between the brackets 118 and 119, the inner shell 2 is not fixed to the supporting unit 1.

Figure 11:
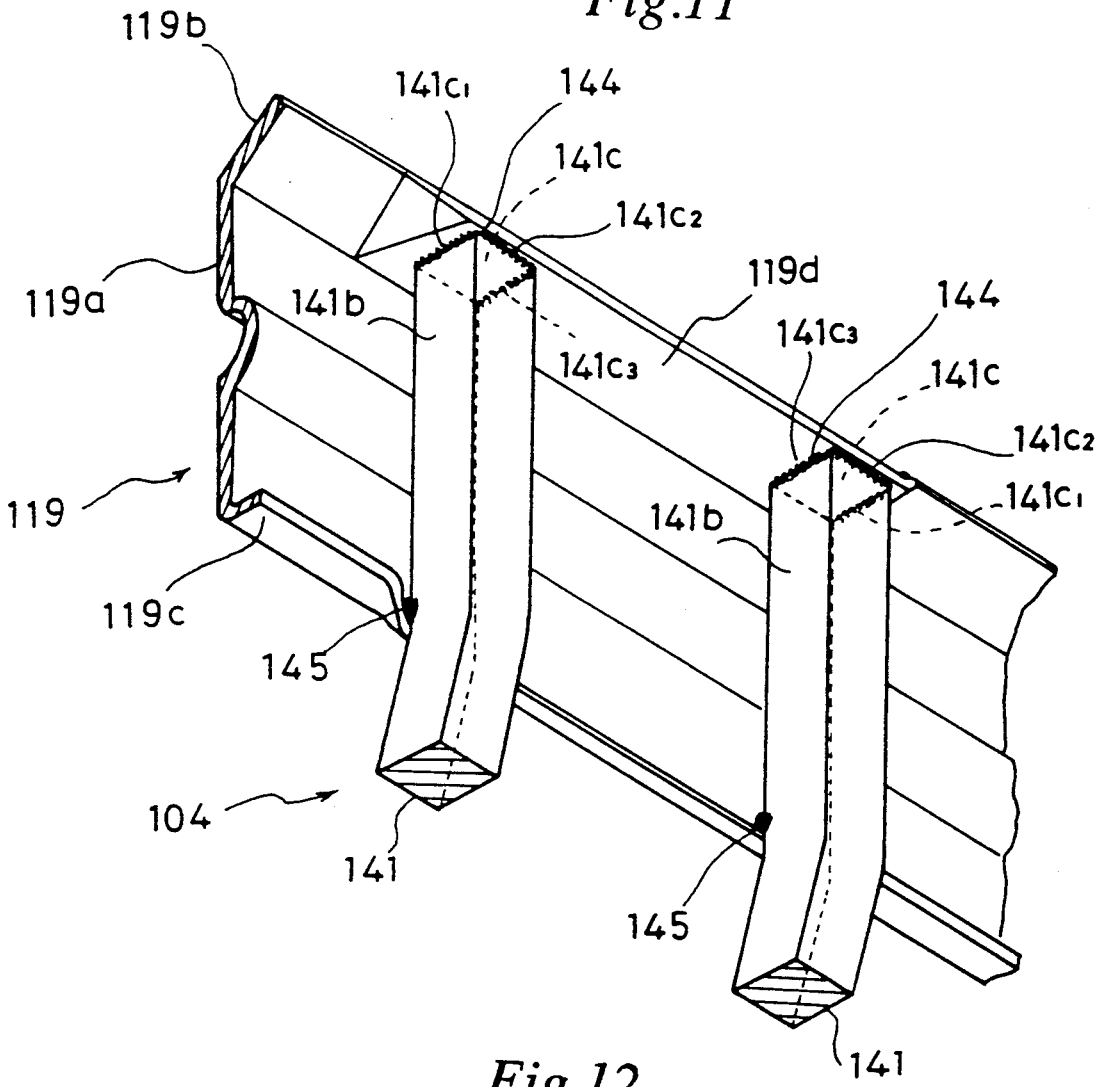
Figure 12:
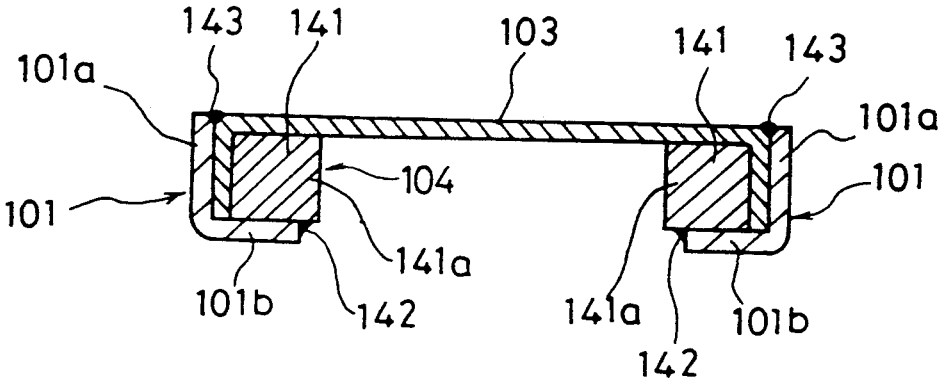

A concrete arrangement for connecting the connecting member 103 and the backrest bracket 119 to the backrest support 104 will be described with reference to FIGS. 11 and 12. The backrest support 104 comprises a pair of metallic solid square bars 141 spaced laterally apart from each other. The lower ends 141*a* of the solid square bars 141 are connected by the connecting member 103 welded thereto as at 142 and 143. In particular, as shown in FIG. 12 the connecting member 103 comprises a metallic plate bent like the letter U, to the outer side surfaces of which the rear end portions 101*a* of the balancing members 101 are attached. The rear end portion 101*a* of each balancing member 101 is provided with a bent portion 101*b* for receiving the under surface of each solid square bar 141. The bent portions 101*b* of the balancing members 101 and the solid square bars 141 are connected by welding as at 142, and the balancing members 101 and the connecting member 103 are connected by welding as at 143. On the other hand, as shown in FIGS. 5 and 11, the backrest bracket 119 is an integral body formed from a metallic plate by press work and comprising a face plate 119*a*, a reinforcing upper edge portion 119*b* extending rearwardly from the upper edge of the face plate 119*a* and a reinforcing lower edge portion 119*c* extending rearwardly from the lower edge of the face plate 119*a*. A recessed portion 119*d* is formed by depressing a middle portion of the reinforcing upper edge portion 119*b* so deeply that the portion 119*d* makes right angles with the face plate 119*a*. The backrest bracket 119 is then attached to the upper end portions 141*b* of the solid square bars 141, with the under surface of the recessed portion 119*d* resting on the upper end surfaces 141*c* of the solid square bars 141. The three side edges $141c_1$, $141c_2$ and $141c_3$ of the upper end surfaces 141*c* of the solid square bars 141 are welded at 144 to the under surface of the recessed portion 119*d*. In this embodiment, the reinforcing lower edge portion 119*c* of the backrest bracket 119 and the solid square bars 141 are welded at 145 for additional reinforcement.

On the other hand, as shown in FIG. 2 through FIG. 4 and FIG. 13, the inner shell 2 is an integral body L-shaped in side view, comprising a portion 21 corresponding to the seat and a portion 22 corresponding to the backrest and made of resiliently deformable synthetic resin, such as polypropylene, polyethylene, polyvinyl chloride, polyamide, polyester, etc. The seat portion 21 is of such a shape that both its right and left side edge portions 21*e* and its central portion are slightly raised, with nuts 23 fixed on the lateral portions 21*s* near the front ends of the right and left side edges thereof. The inner shell 2 is fixed to the seat receiving frame 105 by bolts 24 penetrating through the above-mentioned seat bracket 118 near the opposite ends thereof and threaded into the nuts 23. In this embodiment, nuts 25 are also fixed to the central portion of the inner shell 2 near the front end thereof, and auxiliary bolts not shown are penetrated through the front end portion of the seat receiving frame 105 to be threaded into the nuts 25 for reinforcement of the fixing strength of the inner shell 2. The backrest portion 22 is so shaped that both its right and left side edges 22*e* are slightly curved forwardly, and nuts 26 are fixed to the lateral portions 22*s* near both side edges at substantially the same height as the backrest point d. The inner shell 2 is connected to the backrest support 104 by penetrating bolts 27 as fixing means through the backrest bracket 119 near the opposite ends thereof and threading the bolts 27 into the nuts 26. The border portion 28 between the seat portion 21 and the backrest portion 22 of the inner shell 2 is not curved forwardly near both the right and left side edges 28*e* thereof, but is curved so as to protrude rearwardly to form a semi-circular shape in side view. Two parallel slits 29 extending vertically are formed in the border portion 28 perpendicularly to the backrest bracket 119. The lower ends 29*a* of the two slits 29 reach the rear portion of the seat portion 21 and the upper ends 29*b* thereof extend to a point higher than the backrest point d of the backrest portion 22, with a portion between the slits 29 formed into a belt member 290. The belt member 290 consists of a curved portion 291 connected to the backrest portion 22, bellows 292 extending from the lower end of the curved portion 291, and a depending portion 293 connecting the lower portion of the bellows 292 to the seat portion 21. The curved portion 291 is curved so as to protrude slightly forwardly, with the backrest point d for supporting the fifth lumbar vertebra of the user being positioned on the front surface thereof. The curved portion 291 is made thicker than that of the bellows 292 and the depending portion 293. Reinforcing ribs 294 are provided on that portion of the curved portion 291 which is connected to the backrest portion 22. The bellows 292 are so formed so as to be expandable and compressible in upward and downward directions. The belt member 290 integrally connects the base portion 22*c* where the upper portion 22*a* of the backrest portion 22 is inclinable relative to the lower portion 22*b* thereof to the rear end of the seat portion 21, so that as will be described later, when the upper portion 22*a* of the backrest portion 22 is rearwardly inclined relative to the lower portion 22*b*, the curved portion 291 can protrude forwardly relative to the lower portion 22*b*. A resin injection port used for forming the inner shell 2 leaves a mark 20 on the depending portion 293 of the belt member 290 which corresponds to the center of the shell 2. At both sides of the resin injection mark 20 the slits 29 are positioned.

Figure 13:
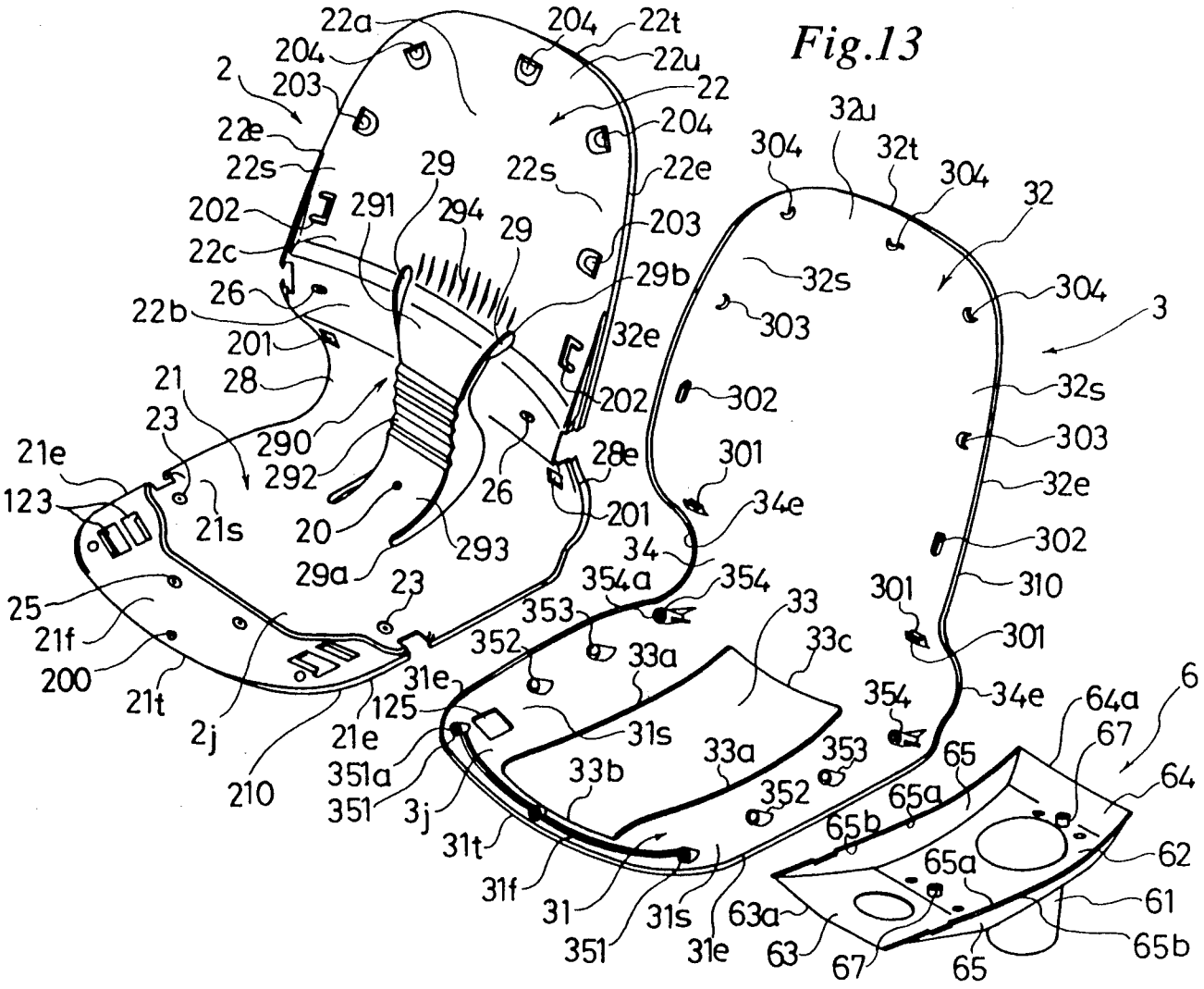
Figure 14:
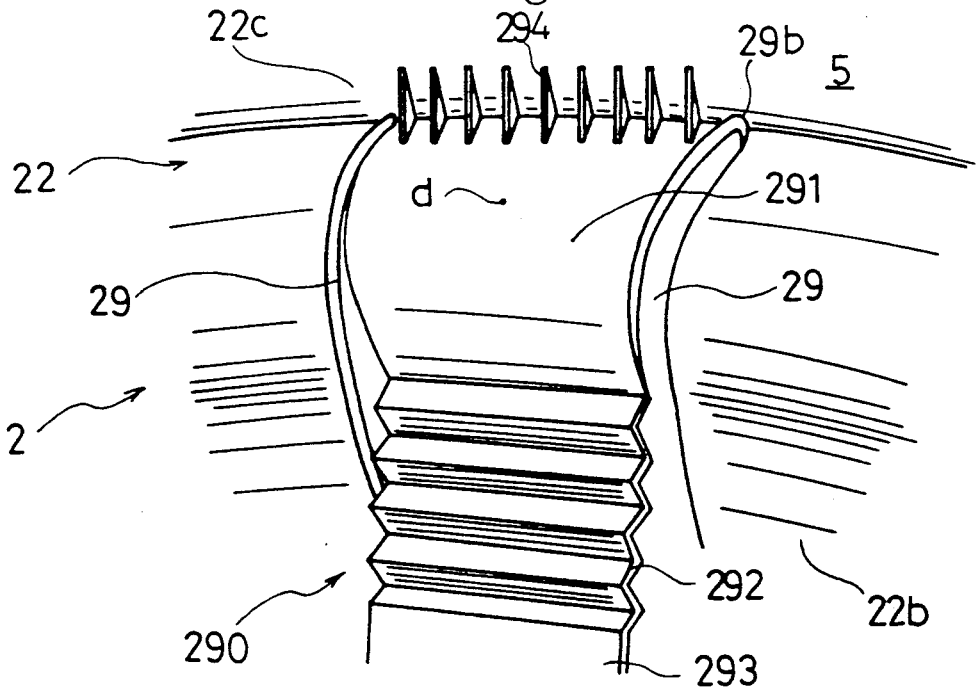
Figure 27:
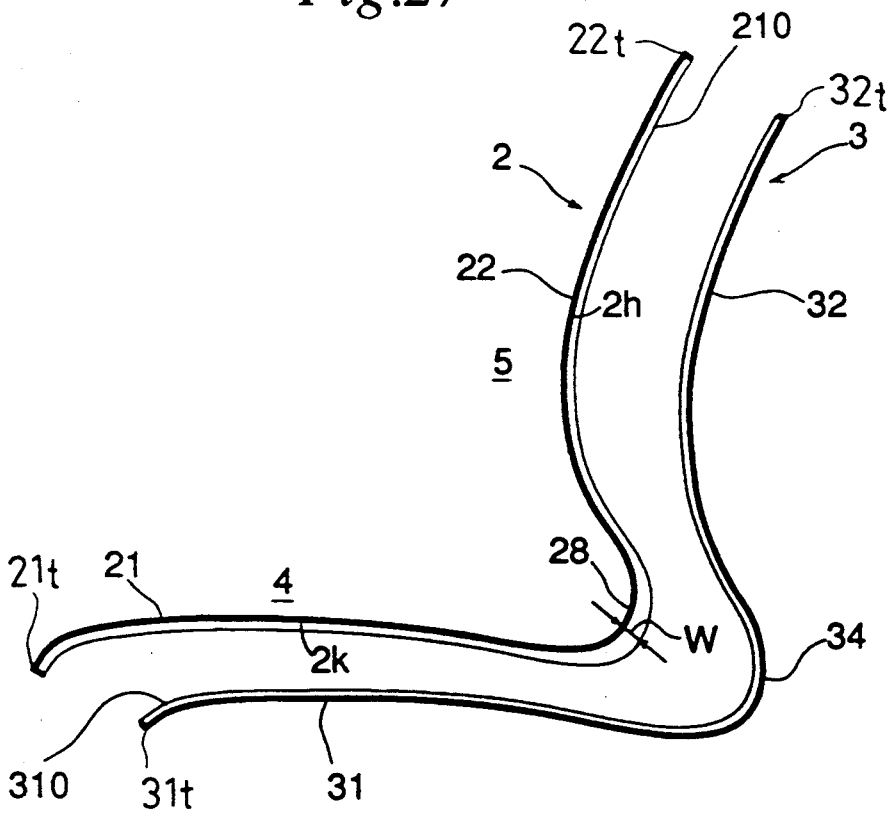

Along the outer circumferential edge of the inner shell 2, there is provided a continuous brim 210 extending downwardly and rearwardly as shown in FIGS. 13 and 27. In particular, the above-mentioned brim 210 is integrally formed on the front edge 21*t* of the seat portion 21 of the inner shell 2 (refer to FIG. 4), both the right and left side edges 21*e* of the seat portion 21 (refer to FIG. 28), both the right and left side edges 28*e* of the border portion 28 (refer to FIG. 29), both the right and left side edges 22*e* of the backrest portion 22 (refer to FIG. 30) and the upper edge 22*t* of the backrest portion 22 (refer to FIG. 25). The width W of the brim 201 is greater on the border portion 28 than on the other portions.

Figure 16:
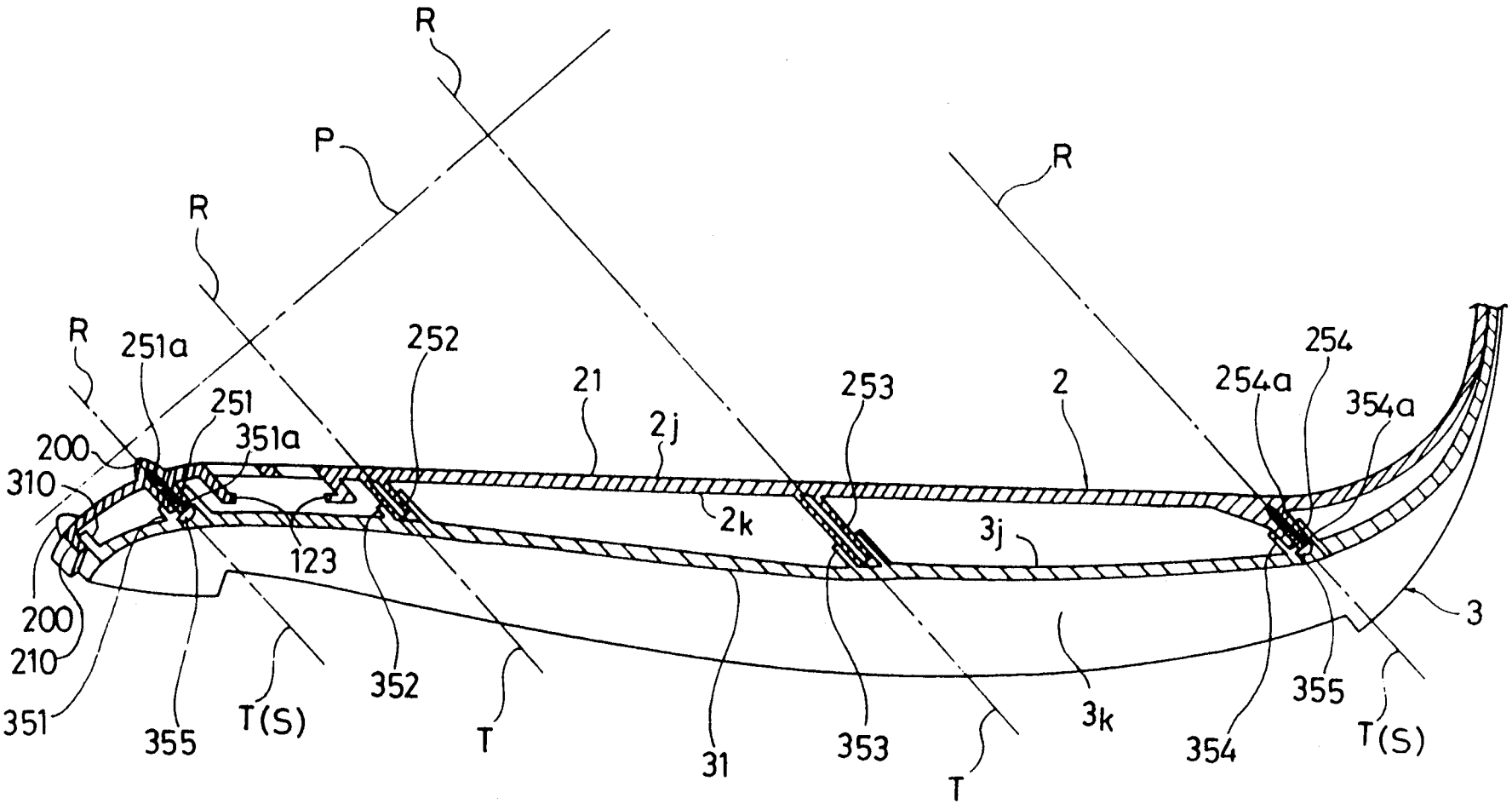
Figure 28:
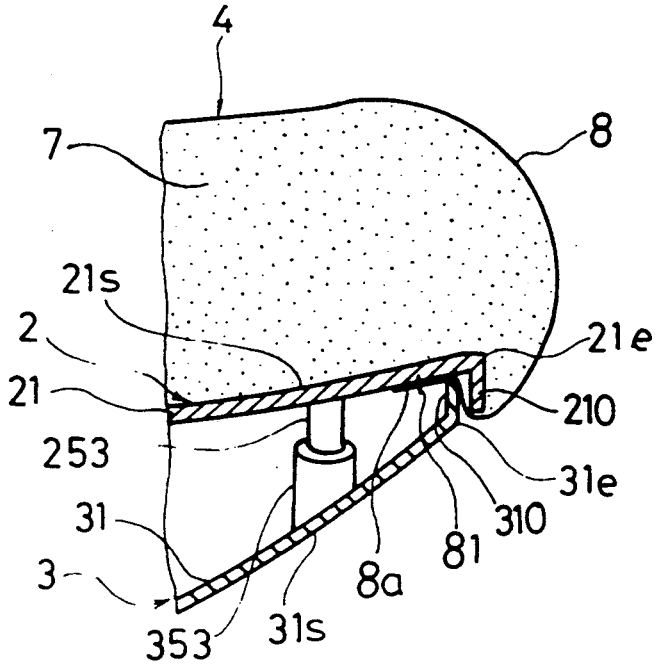
Figure 29:
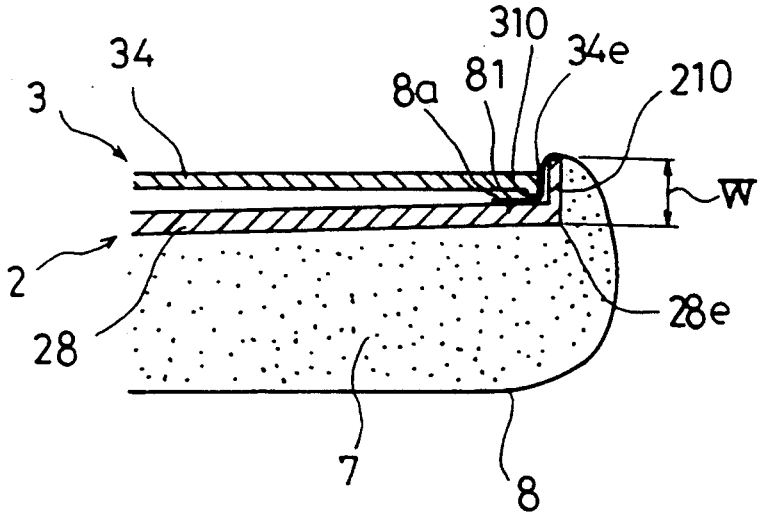
Figure 30:
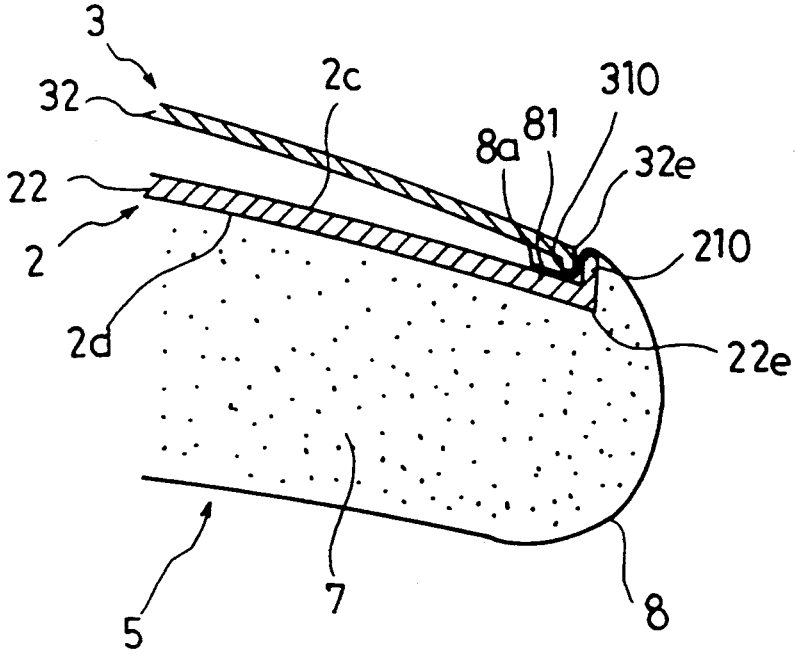
Figure 31:
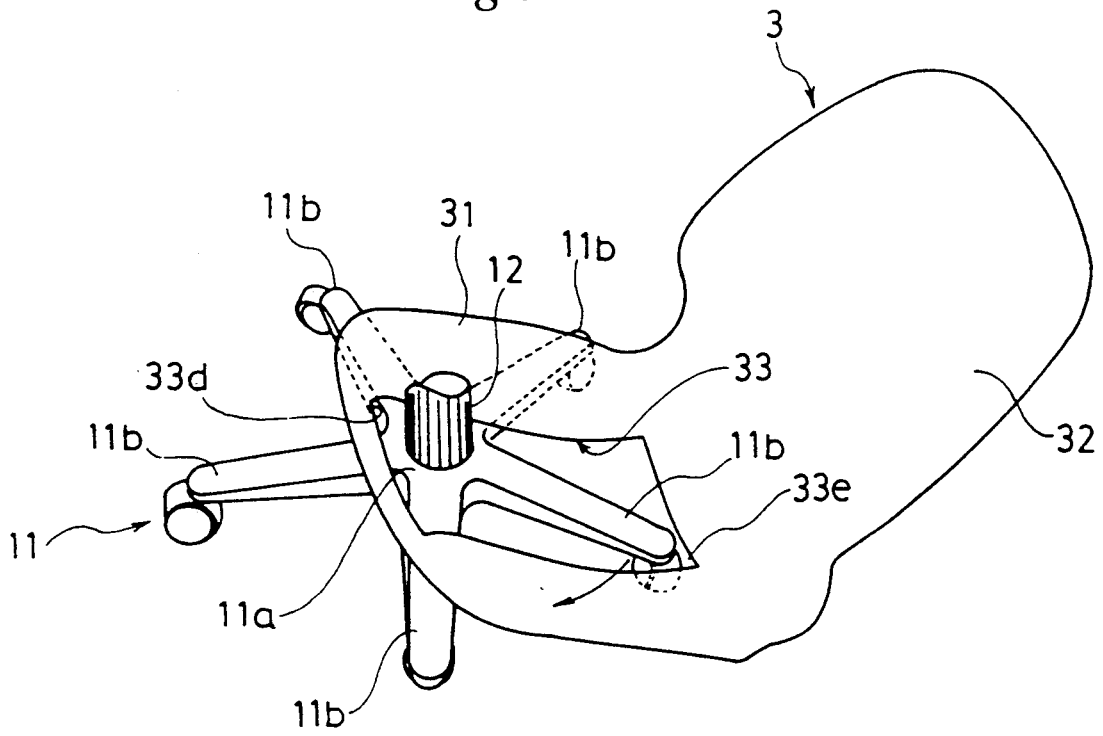
Figure 32:
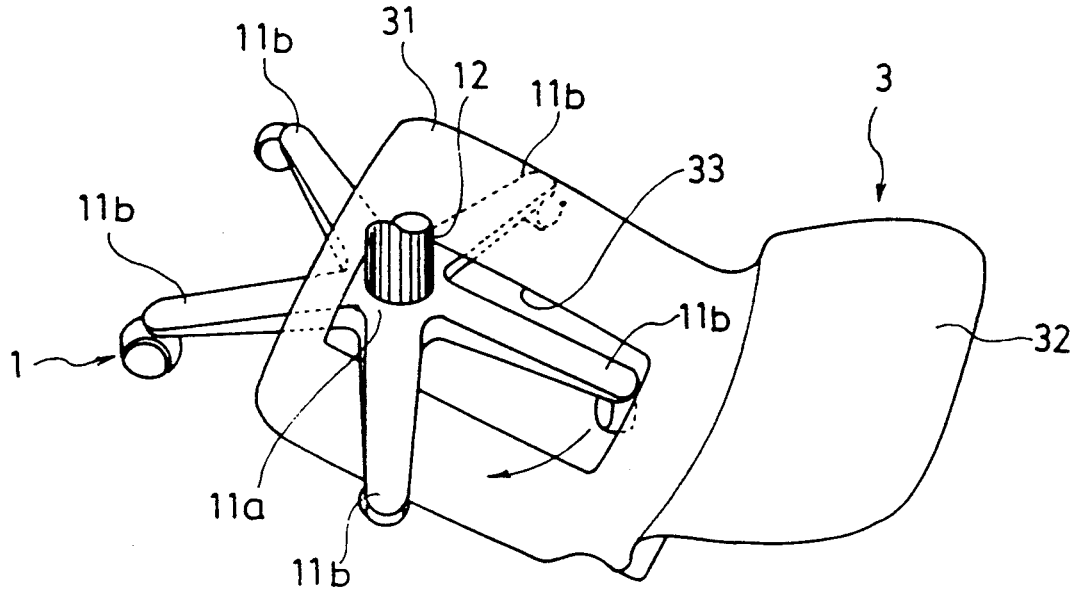

The seat portion 21 of the inner shell 2 is so shaped in the front edge portion 21*f* as to gradually descend forwardly, on the upper surface of which a plurality of projections 200 are formed integrally therewith. As shown in FIGS. 4, 13 and 16, the projections 200 are, for example, spindle-shaped and protrude aslant in a forwardly upward direction making an angle of 45° with the seat surfaces. An upholstery 8 covers the upper surface 2*j* of the inner shell 2 with a pad 7 interposed therebetween. The pad 7 is made of, for example, urethane resin and the upholstery 8 is made of cloth the inner surface of which is lined with urethane film. The pad 7 is attached directly to the inner shell 2, and near the front edge portion 21*f* of the seat portion 21 the projection 200 is pushed into the under surface 7*k* of the pad 7, as shown in FIG. 4. As shown in FIGS. 28 through 30, the peripheral portion 8*a* of the upholstery 8 is inturned onto the under surface 2*k* and the back surface 2*h* of the inner shell 2, and the upholstery 8 suitably tensioned is fixed to the inner shell 2 by a plurality of tacks 81.

On the other hand, the outer shell 3 is integrally composed of a seat portion 31 and a backrest portion 32 L-shaped in side view as shown in FIGS. 1 through 4 and FIG. 13 and made of resiliently deformable synthetic resin like the inner shell. The seat portion 31 is formed into a downwardly spherical contour and provided with a longitudinally extending rectangular opening 33 at the central portion thereof. The backrest portion 32 is curved so that both the right and left side edges 32*e* protrude forwardly, with its curvature gradually increasing from the upper edge 32*t* toward the backrest point d. The curvature of the outer shell 3 near the backrest point d of the outer shell 3 is greater than that of the inner shell 2 at the same level. The curvature of the border portion 34 between the seat portion 31 and the backrest portion 32 of the outer shell 3 is set to nearly zero in the right and left side edges 34*e*. The border portion 34 is curved so as to protrude rearwardly into a semi-circular shape in side view and positioned close to the border portion 28 of the inner shell 2.

Along the peripheral edge of the outer shell 3*a* a continuous brim 310 extending upwardly and forwardly is provided as shown in FIGS. 13 and 27. In particular, the above-mentioned brim 310 is integrally formed on the front edge 31*t* of the seat portion 31 of the outer shell 3 (refer to FIG. 4), both the right and left side edges 31*e* of the seat portion 31 (refer to FIG. 28), both the right and left side edges 34*e* of the border portion 34 (refer to FIG. 29), both the right and left side edges 32*e* of the backrest portion 32 (refer to FIG. 30), and the upper edge 32*t* of the backrest portion 32 (refer to FIG. 25).

Under the condition that the outer shell 3 is mounted on the inner shell 2, the brim 310 of the outer shell 3 is positioned inside and nearly parallel to the brim 210 of the inner shell 2. The peripheral portion 8*a* of the upholstery 8 extends over the brims 210 and 310 to reach the under surface 2*k* and the back surface 2*h* of the inner shell 2.

The outer shell 3 is supported on only the inner shell 2. The arrangement for fixing the outer shell 3 to the inner shell 2 is shown in FIGS. 16 through 26. The front edge portion 31*f* and the side edge portions 31*s* of the seat portion 31 of the outer shell 3 are detachably fixed to the front edge portion 21*f* and the side edge portions 21*s* of the seat portion 21 of the inner shell 2 by screws from outside. In particular, the inner shell 3 is provided on the under surface 2*k* thereof with a plurality of pins 251, 252, 253 and 254 projecting perpendicularly to an imaginary plane P extending between the front edge 4*t* of the seat 4 and the upper edge 5*t* of the backrest 5, with their axes R extending parallel with each other, and the outer shell 3 is provided on the upper surface thereof with a plurality of hollow cylindrical portions 351, 352, 353 and 354, with their axes T being aligned with the axes R of the pins 251, 252, 253 and 254, so that the pins 251, 252, 253 and 254 are fitted into the hollow cylindrical portions 351, 352, 353 and 354, thereby to connect the outer shell 3 to the inner shell 2. The seat portion 31 of the outer shell 3 is fixed to the seat portion 21 of the inner shell 2 by bolts 355 screwed in the direction coinciding with the axes R and T. Concretely, the particular pins 251 and 254 are formed in the outer end faces with threaded holes 251*a* and 254*a* along the axes R, and the corresponding hollow cylindrical portions 351 and 354 into which the pins 251 and 254 are fitted, respectively, are formed in the outer ends with bolt receiving holes 351*a* and 354*a* open in the under surface 3*k* of the outer shell 3. The seat portion 31 of the outer shell 3 is fixed to the seat portion 21 of the inner shell 2 by bolts 355 passing through the bolt receiving holes 351*a*, 354*a* to be screwed into the threaded holes 251*a* and 254*a* of the pins 251 and 254.

On the other hand, the border portion 34 of the outer shell 3 is not connected to the border portion 28 of the inner shell 2.

Figure 17:
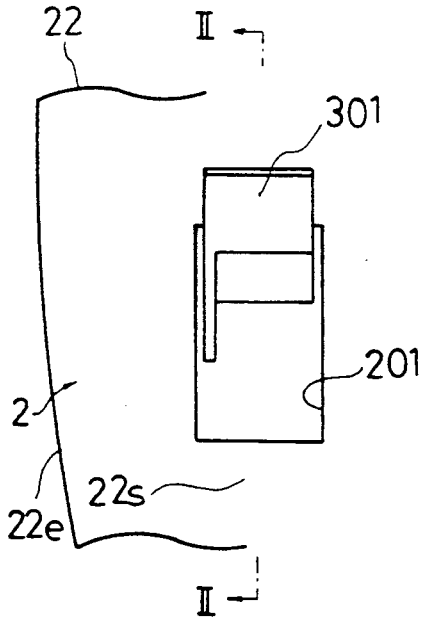
Figure 19:
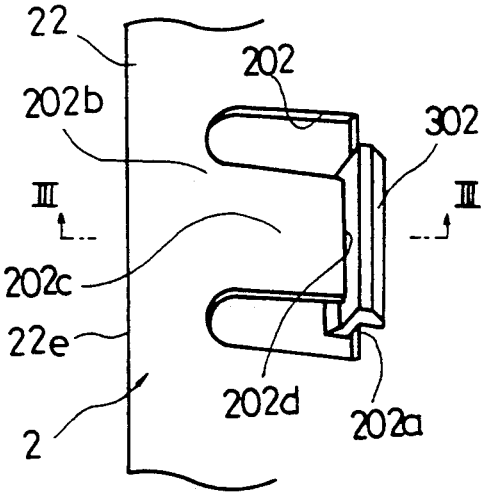
Figure 18:
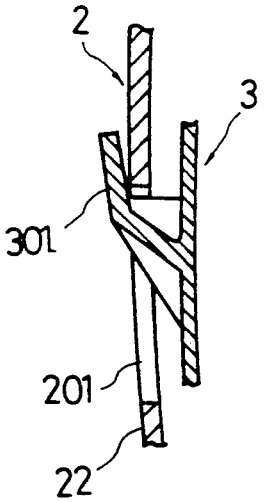
Figure 20:
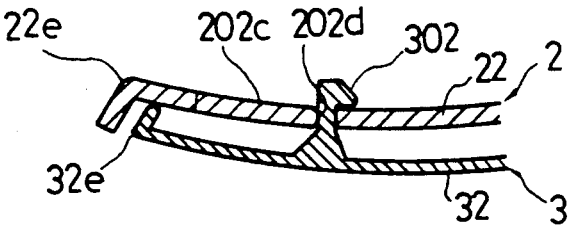
Figure 21:
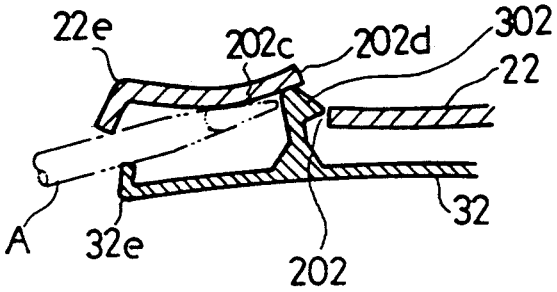
Figure 22:
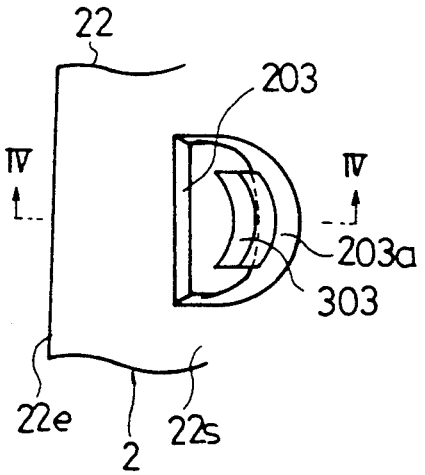
Figure 24:
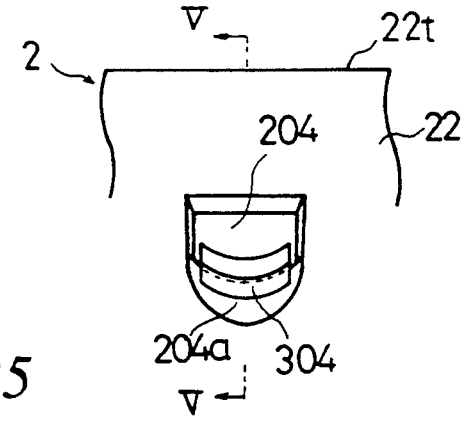
Figure 25:
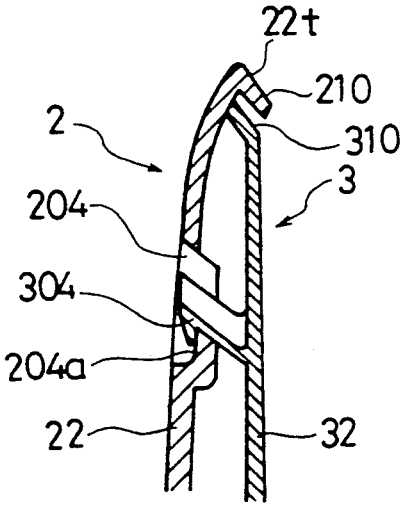
Figure 26:
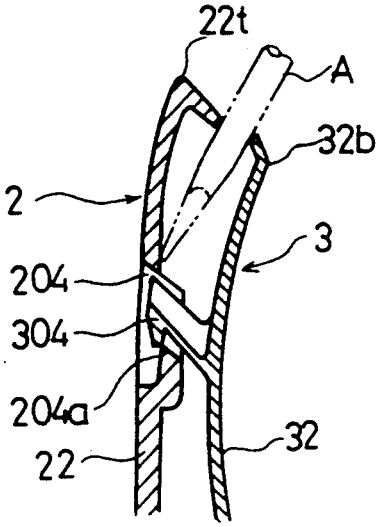
Figure 23:
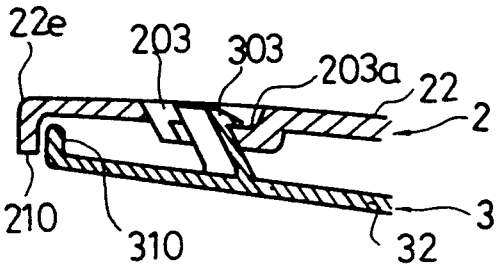

The side edge portions 32*s* and the upper edge portion 32*u* of the backrest portion 32 of the outer shell 3 have claws for connection. In particular, as shown in FIG. 13, upward claws 301 L-shaped in side view, first inward claws 302 having an inner undercut portion and second inward claws 303 also having an inner undercut portion are provided on the side edge portions 32*s* of the outer shell 3 and arranged in the order mentioned at predetermined intervals from the bottom. Downward claws 304 having a lower undercut portion are also provided on the upper edge portion 32*u*. Engaging holes 201, 202, 203 and 204 are formed in the inner shell 2 at the positions which correspond to the claws 301, 302, 303 and 304. The upward claws 301 engage the upper edges of the corresponding engaging holes 201 in such a manner as to allow the claws to move a given distance vertically as shown in FIGS. 17 and 18, and both the inward claws 302 and 303 engage the inner side edges 202*a* and 203*a* of the corresponding engaging holes 202 and 203 as shown in FIGS. 19 through 23, and the above-mentioned downward claws 304 engage the lower edges 204*a* of the corresponding engaging holes 204 as shown in FIGS. 24 to 26 through utilization of the resilient deformation of the respective members. The first inward claws 302 are shaped into an upright wall extending vertically as shown in FIGS. 19 and 20, and the inner side edges 202*a* of the corresponding engaging holes 202 are made linear, and even when they engage each other, the inward claws 302 are slidable vertically relative to the engaging holes 202. A tongue 202*c* bendable in the direction of the thickness thereof is integrally provided so as to project from the outer lateral edge 202*b* of the engaging hole 202, with a free tip end 202*d* of the tongue 202*c* abutting on the outer surface of the claw 302 engaging the inner side edge 202*a*. The second inward claws 303 are formed into a semicircular shape similar to the downward claws 304 as shown in FIGS. 22 and 23, and the engaging holes 203 are of such a size that even when the second inward claws 303 engage the engaging holes 203, they are also slightly slidable in vertical direction. The depth and direction of engagement of these claws 301, 302, 303 and 304 with the corresponding engaging holes 201, 202, 203 and 204 are set so as to prevent disengagement while in ordinary use. However, they can be separated by disengaging operation from outside. In particular, first, with respect to the downward claws 304 and the second inward claws 303, a rigid rod A such as a screw driver, etc. is inserted between the upper edge 22*t* or the side edge 22*e* of the inner shell 2 and the upper edge 32*t* or the side edge 32*e* of the outer shell 3, and the upper edge portion or the side edge portion of the outer shell 3 is pushed down to be resiliently deformed, whereupon the corresponding downward claws 304 or the inward claw 303 is deflected so as to raise their jaw thereby to fall out of the engaging hole 204 or 203. On the other hand, with respect to the first inward claws 302, a rigid rod A such as a screw driver, etc. is inserted between the side edge 22*e* of the inner shell 2 and the side edge 32*e* of the outer shell 3 as far as the tip of the rod abuts on the tip end of the tongue 202*c* as shown in FIG. 21. Under the condition, upon pushing rearwardly the rod A on the side edge 32*e* of the above-mentioned outer shell 3 as a fulcrum, the tip end of the rod A pushes the tongue 202*c* forwardly, so that the tongue 202*c* is deformed in the direction of thickness and the free end 202*d* thereof moves beyond a position where it cannot abut on the inward claw 302. At this moment the above-mentioned inward claw 302 is deflected so as to raise its jaw as the outer shell 3 is deformed thereby to fall out of the engaging hole 202.

In this chair, the dimensions of the legs 11*b* and the opening 33 are determined so that when the above-mentioned legs 11*b* are relatively rotated, with the corner 33*d* at the end of one longitudinal side of the opening 33 in the outer shell 33 being positioned near the center of the base 11 constituting the supporting unit 1, the tip end of each leg 11*b* can pass through the opposite corner 33*e* of the opening 33. As a result, the outer shell 3 can be detached from the chair without disassembling the supporting unit 1.

Figure 34:
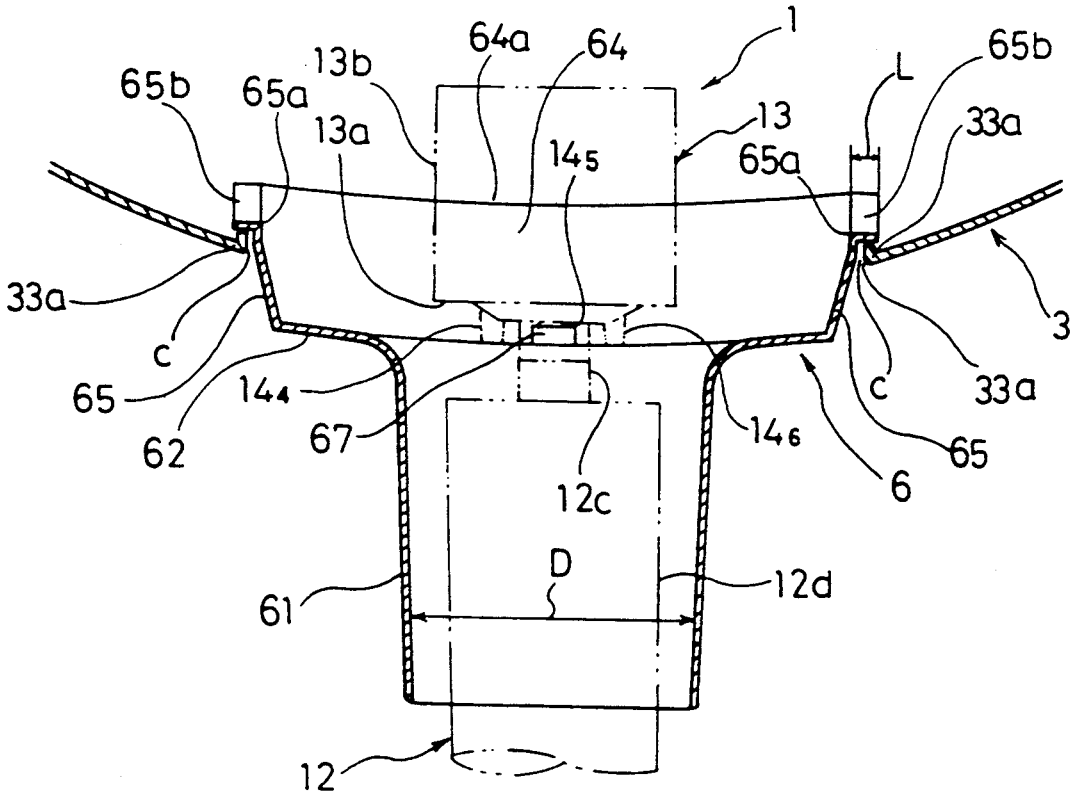

A fixed shell 6 is provided to close the opening 33 of the outer shell 3 as shown in FIGS. 1, 2, 4 and 13. The fixed shell 6 is ship-shaped and provided with a bottom wall 62 having a cylindrical cover 61 enclosing the column 12, a front wall 63 extending continuously from the front end of the bottom wall 62, a rear wall 64 extending continuously from the rear end of the bottom wall 62, and side walls 65 formed integrally with the right and left side edges of the rear wall 64, the bottom wall 62 and the front wall 63. The fixed shell is formed of synthetic resin, such as polypropylene, etc. into a rectangular shape in plan view corresponding to that of the opening 33. The upper edge 63*a* of the front wall 63, the upper edge 64*a* of the rear wall 64 and the upper edge 65*a* of the side wall 65 of the fixed shell 6 are inserted into the opening 33 of the outer shell 3, and both the right and left side edges 33*a*, the front edge 33*b* and the rear edge 33*c* of the opening 33 are positioned close to the side walls 65, the front wall 63 and the rear wall 64 of the fixed shell 6, respectively. In this embodiment, as will be described later, when the backrest 5 is inclined from the reference position a as shown in real line in FIG. 2 to the positions b and c shown in imaginary line, apparently the seat 4 is moved forwardly, with its front portion being lifted and its rear portion slightly lowered, and with the front edge 33*b* and the rear edge 33*c* of the opening 33 in the outer shell 3 approximately following the movement. Therefore, the front wall 63 and the rear wall 64 of the above-mentioned fixed shell 6 are formed so as to conform to the loci of movement of the front edge 33*b* and the rear edge 33*c* so as to be constantly positioned close to the fixed shell 6. As shown in FIG. 34, the fixed shell 6 is formed on the upper edge 65*a* of the side walls 65 with a flange 65*b* projecting therefrom so as to be positioned over a gap c formed between each side wall 65 and each side edge 33*a* of the opening 33. The length L of projection of the flanges 65*b* is such that the upper edges 63*a*, 64*a* and 65*a* of the fixed shell 6 can be taken out from the opening 33 by resiliently deforming the side walls 65 so as to be bent inwardly or resiliently deforming the front wall 63 or the rear wall 64 so as to be curved. The cylindrical cover 61 is of such a shape that the inner diameter D gradually increases in upward direction, so that the fixed shell 6 can be easily inclined when the fixed shell is attached to or detached from the opening 33 of the fixed shell 6.

Figure 33:
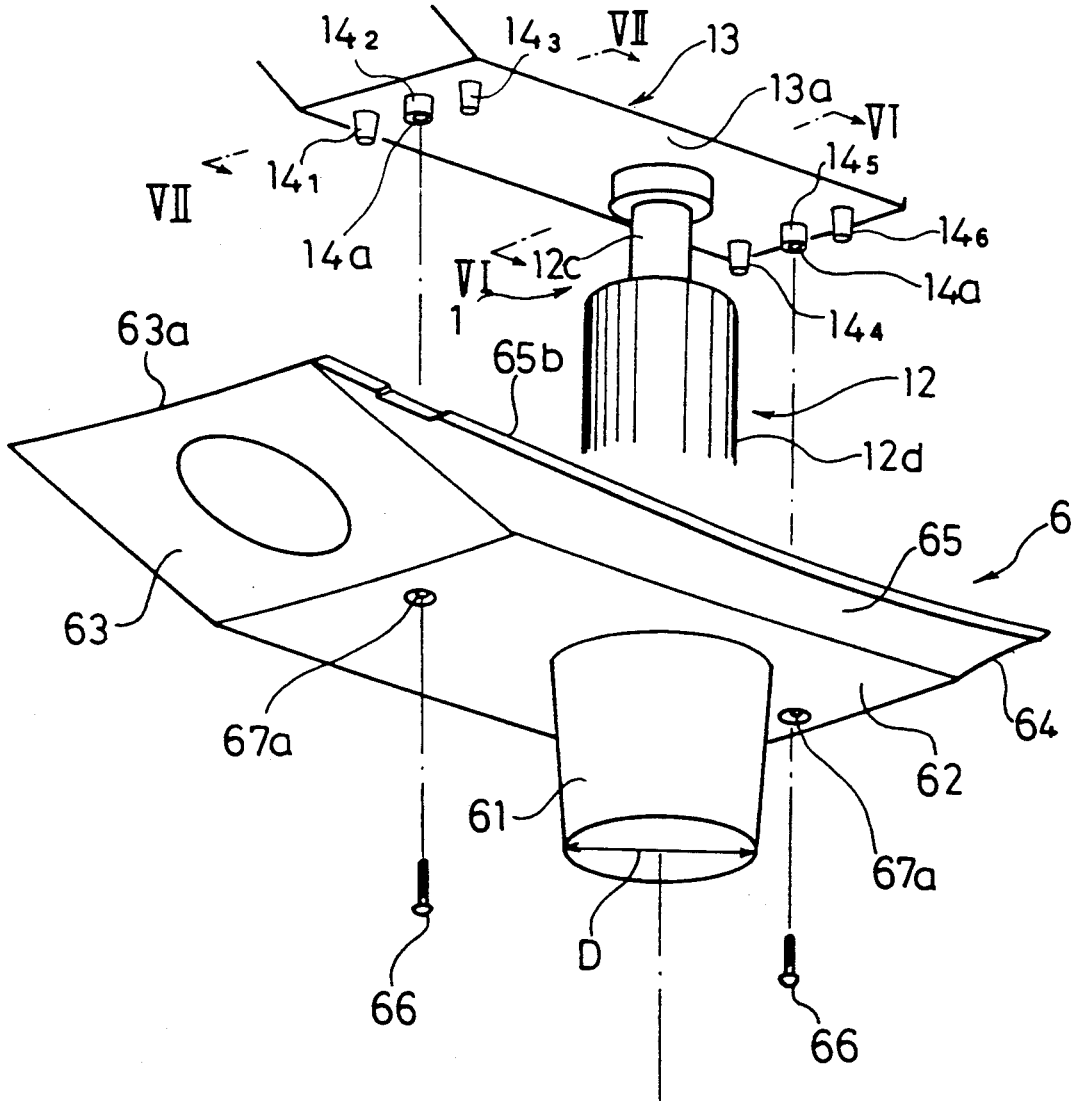
Figure 35:
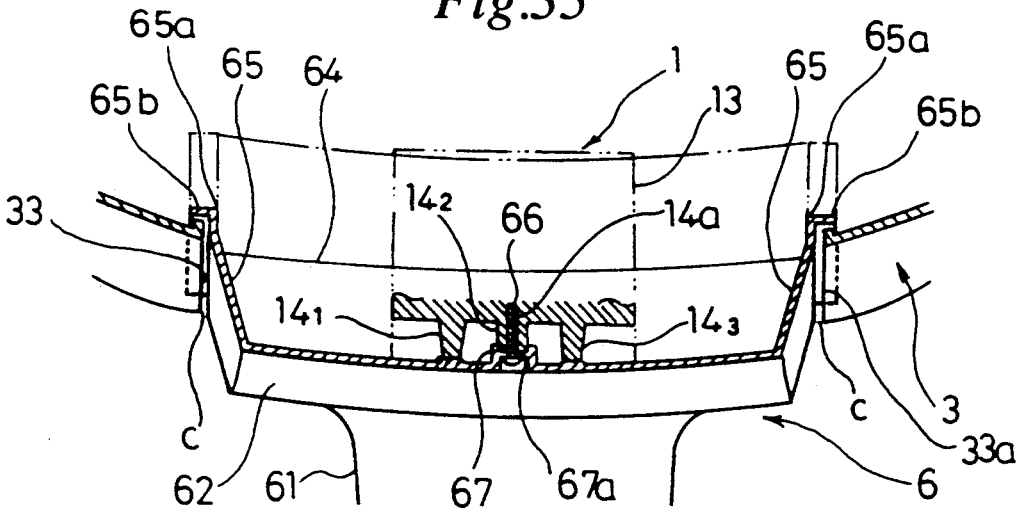

A manner of fixing the fixed shell 6 to the supporting base 13 is shown in FIGS. 33 through 35. In particular, six projecting pins $14_1 \sim 14_6$ are integrally formed on the bottom wall 13*a* of the supporting base 13, and the tip ends of the pins $14_1 \sim 14_6$ abut on and support the inner surface of the fixed shell 6. The two intermediate pins $14_2$ and $14_5$ are formed in the top end surface with a threaded hole 14*a*, and the fixed shell 6 is provided at the corresponding positions with cylindrical portions 67 for receiving the pins $14_2$ and $14_5$, and the outer end of each cylindrical portion 67 is formed with a bolt receiving bore 67*a* through which a bolt 66 is inserted. By threading the bolt 66 through the bolt receiving hole 67*a* into the inserting hole 14*a*, the central portion of the fixed shell 6 is fixed to the supporting base 13 at two points. In this arrangement, the upper edge portion of the fixed shell 6 can be comparatively easily deformed by an extenal force, so that even with dimensional errors the fixed shell will not be in strong frictional contact with the outer shell 3.

Figure 39:
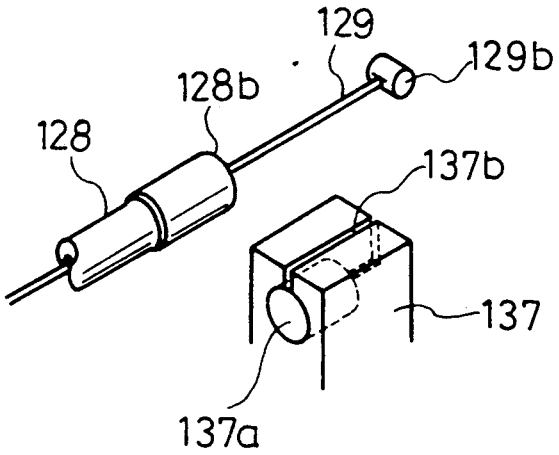
FIGS. 39-52 show another embodiment of the invention.
Figure 40:
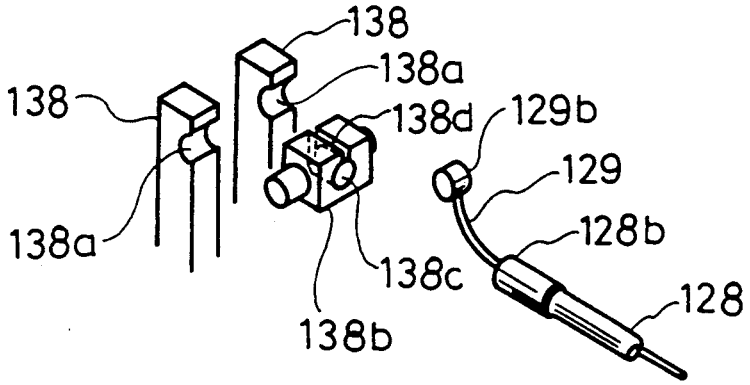
Figure 41:
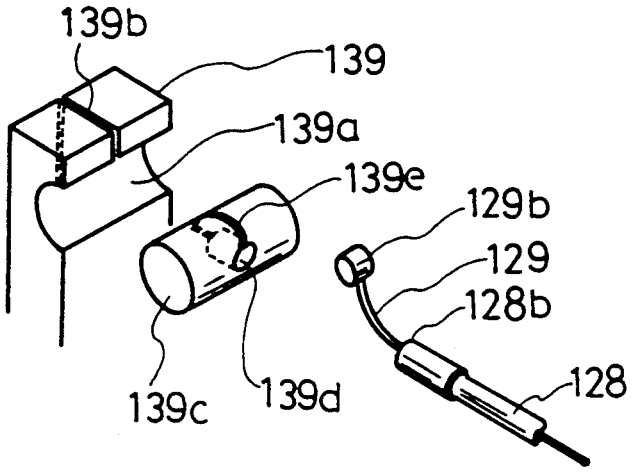
Figure 45:
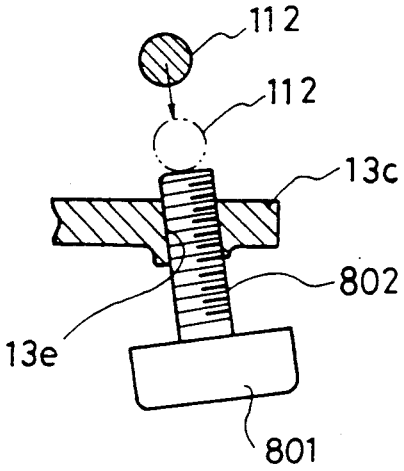
Figure 42:
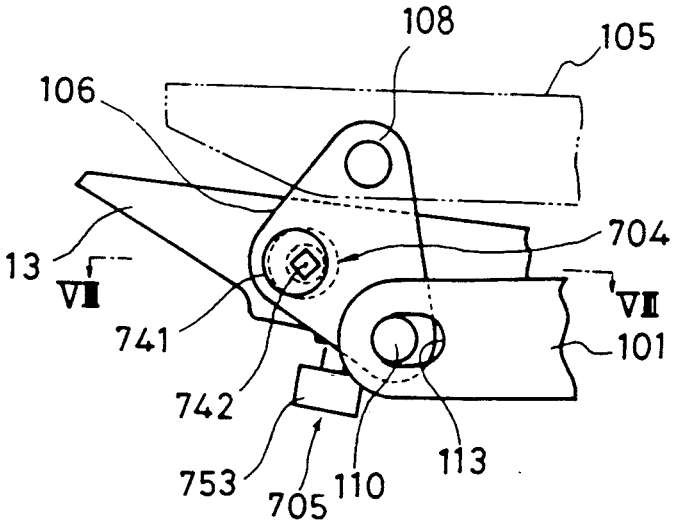
Figure 43:
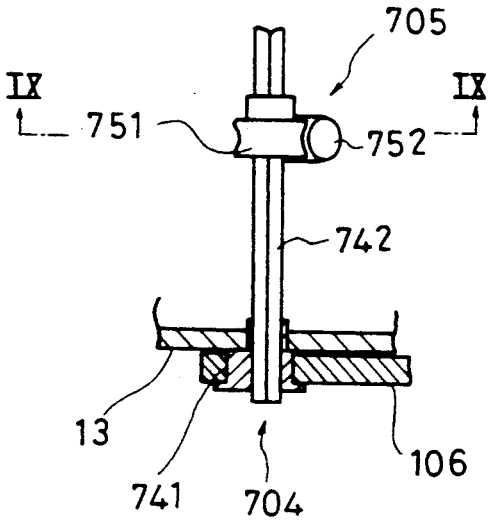
Figure 44:
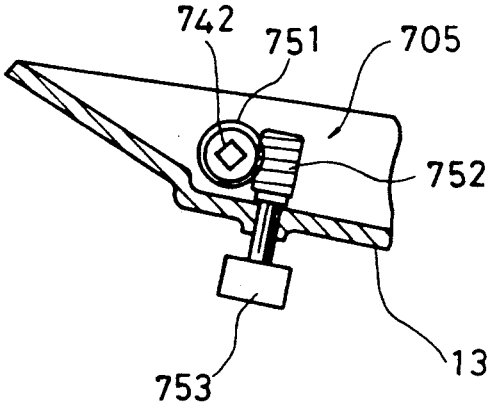

Moreover, in this chair, as shown in FIGS. 3 through 5, a manual controller 120 is provided on the inner shell 2, and a seat height regulating mechanism 121 controlled by the manual controller 120 is provided within the supporting base 13 of the supporting unit 1. The manual controller 120 is provided with a slider 122 which comprises recesses 122*a* formed on both sides thereof and slidably engaging plate-like rails 123 formed integrally on the inner shell 2, and a handle 124 provided on the under surface of the slider 122, the handle 124 projecting outside through a window 125 provided on the above-mentioned outer shell 3. On the other hand, as shown in FIG. 4 the mechanism 121 is provided with a pivotable arm 126 the middle portion of which is pivotally supported by an intermediate shaft 114, and a transmission wire 127 connecting one movable end 126*a* of the pivotable arm 126 to the above-mentioned slider 122. The other movable end 126*b* of the pivotable arm 126 bears on the upper end of the operating rod 12*e* of a gas spring 12*a*. By controlling the handle 124 to slide the slider 122 in the direction of an arrow X, thereby pulling the movable end 126*a* of the pivotable arm 126 by means of the transmission wire 127, the pivotable arm 126 is rotated, so that the other movable end 126*b* thereof can control the operating rod 12*e* of the gas spring 12*a*. The transmission wire 127 comprises a core wire 129 slidably passing through a guide tube 128. Fixed to the opposite ends of the core wire 129 are cylindrical fixing members 129*a* and 129*b* which are fixed to the handle 124 and the one movable end 126*a* of the pivotable arm 126, respectively. On the outer end 128*a* of the guide tube 128 there is provided a regulating member 133 having a portion 131 to be engaged by a wrench and a male thread 132, and this regulating member 133 is supported on the under surface of the inner shell 2 by means of a bracket 134. The male thread 132 of the regulating member 133 is inserted through the bracket 134, and the guide tube 128 is fixed by sandwiching the bracket 134 between a pair of nuts 136 engaging the male thread 132. By loosening the nuts 136 the fixed position of the guide tube 128 can be adjusted. As shown in FIG. 4, the inner end 128*b* of the guide tube 128 may be fixed to the supporting base 13 by a fixing device similar to that for the outer end 128*a* thereof, or it may also be supported so as not to be adjustable as shown in FIGS. 39 to 41. In particular, in FIG. 39 a fixing block 137 is integrally formed on the bottom wall 13*a* of the supporting base 13. The fixing block 137 is provided with a holding hole 137*a* having a bottom and communicating with a slit 137*b* for the wire to pass through. The inner end 128*b* of the guide tube 128 is fitted into the holding hole 137*a*. In the arrangement shown in FIG. 40, a semi-cylindrical holding recess 138*a* is formed in the end portion of each of a pair of fixing rods 138 standing on the bottom wall 13*a* of the supporting base 13, and the opposite shaft portions of a holding block 138*b* are rotatably supported in the holding recesses 138*a*. The holding block 138*b* has a holding hole 138*c* and a slit 138*d* for the wire to pass through and communicating with the hole 138*c*, with the inner end 128*b* of the guide tube 128 being fitted in the holding hole 138*c*. In the arrangement shown in FIG. 41 a fixing block 139 is formed on the bottom wall 13*a* of the supporting base 13 and is provided in the end portion thereof with a semi-cylindrical holding recess 139*a*, and a slit 139*b* communicating with the holding recess 139*a* for the wire to pass through. The opposite ends of a cylindrical holding block 139*c* are rotatably supported in the holding recess 139*b*. The holding block 139*c* has a holding hole 139*d* having a bottom and extending perpendicularly to the axis thereof, and a slit 139*e* communicating with the holding hole 139*d* for the wire to pass through. The inner end 128*b* of the guide tube 128 is fitted in the holding hole 139*d*.

The manual controller 120 and the mechanism 121 have no connection with the outer shell 3 or the fixed shell 6, so that if the outer shell 3 or the fixed shell 6 is removed, the whole function can be retained. The dimension of the slider 122 of the manual controller 120 is such that to whichever position the handle 124 is moved, the slider can always close the window 125 of the outer shell 3 from inside.

Also, in this chair provided with a backrest, as shown in FIGS. 1, 5 and FIGS. 36 through 38, projecting shafts 91 and 92 having circumferential engaging grooves 91*a* and 92*a*, respectively, on the outer end portions thereof are fixed to the right and left ends of a seat bracket 118 provided on the seat receiving frame 105 and a backrest bracket 119 provided on the backrest support 104. Bearings 93 and 94 having radial threaded holes 93*a* and 94*a* are embedded in both ends 9*a* and 9*b* of each of a pair of armrests 9. The armrests 9 are of an inverted L-shape and made of synthetic resin, with the metallic bearings 93 and 94 being embedded in the opposite ends 9*a* and 9*b* thereof by insertion molding. The bearings 93 and 94 are rotatably engaged by the shafts 91 of the corresponding seat bracket 118 and the shafts 92 of the corresponding backrest bracket 119, respectively. The tip ends of bolts 95 and 96 screwed from outside into the threaded holes 93*a* and 94*a* of the bearings 93 and 94 are inserted into the engaging grooves 91*a* and 91*b*. Concretely, both the right and left ends of the seat bracket 118 and those of the backrest bracket 119 are provided outside the seat 4 and the backrest 5 with bent portions 97 and 98. The shafts 91 and 92 project from the outer surfaces of the bent portions 97 and 98. The threaded holes 93*a* and 94*a* are formed so as to face downward. Holes 9*c* and 9*d* for a bolt to be inserted through are formed in the under surfaces of both the armrests 9 so as to communicate with the threaded holes 93*a* and 94*a*, and the tip ends of the connecting bolts 95 and 96 passed through the holes 9*c* and 9*d* and screwed through the threaded holes 93*a* and 94*a* engage the engaging grooves 91*a* and 92*a*, respectively.

Figure 36:
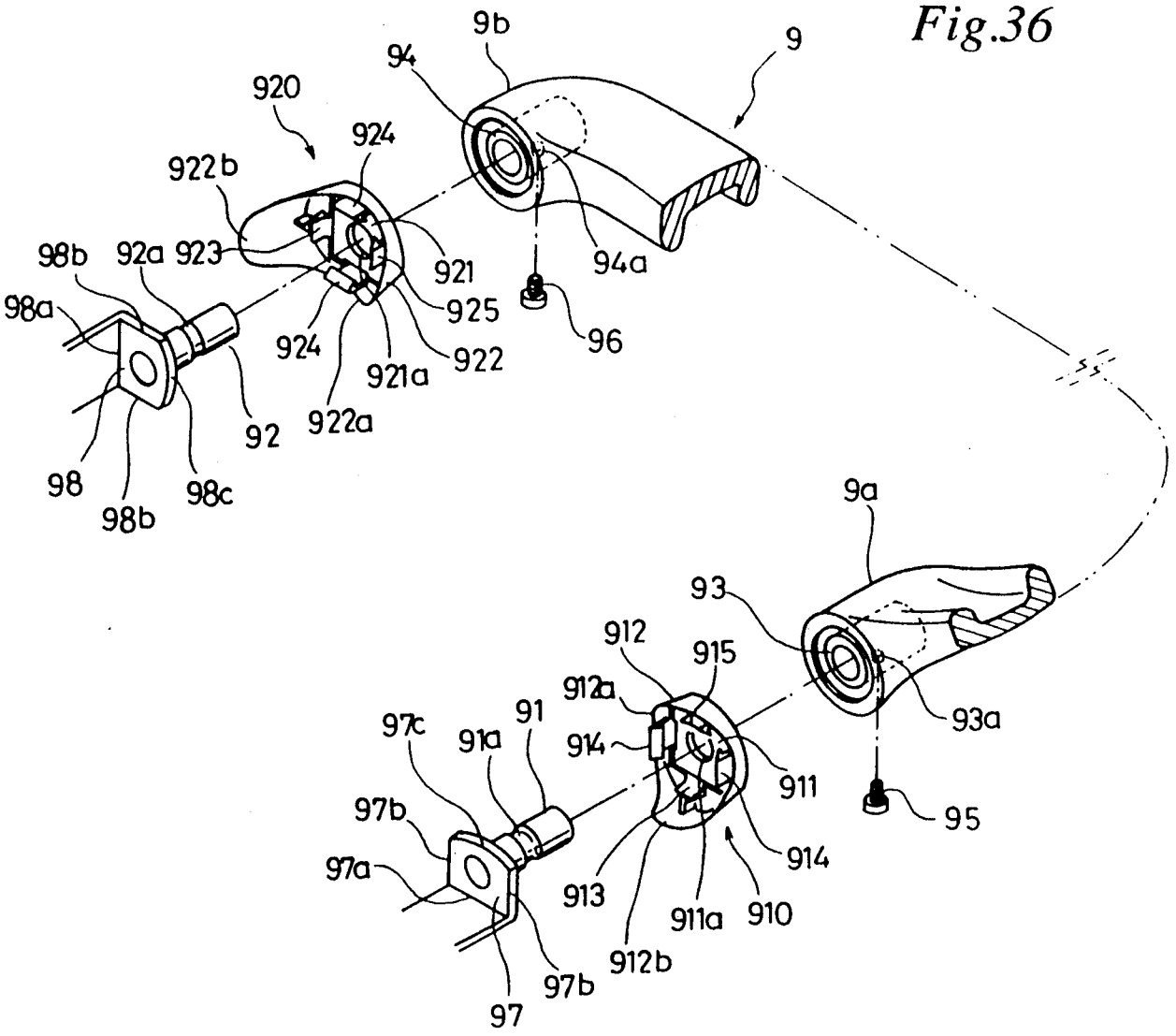
Figure 37:
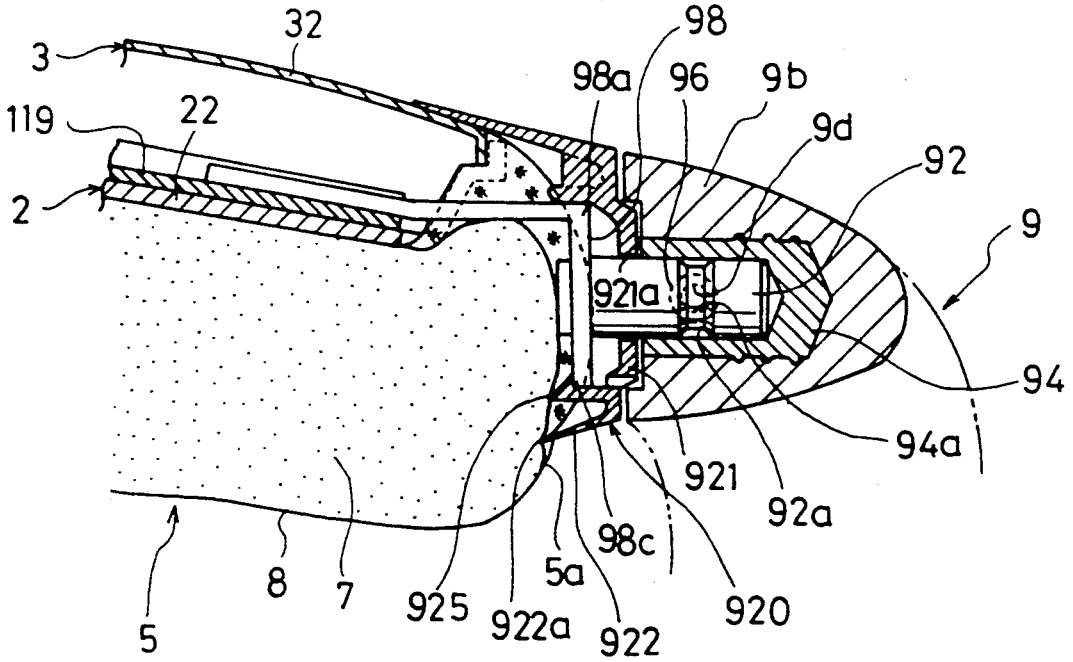
Figure 38:
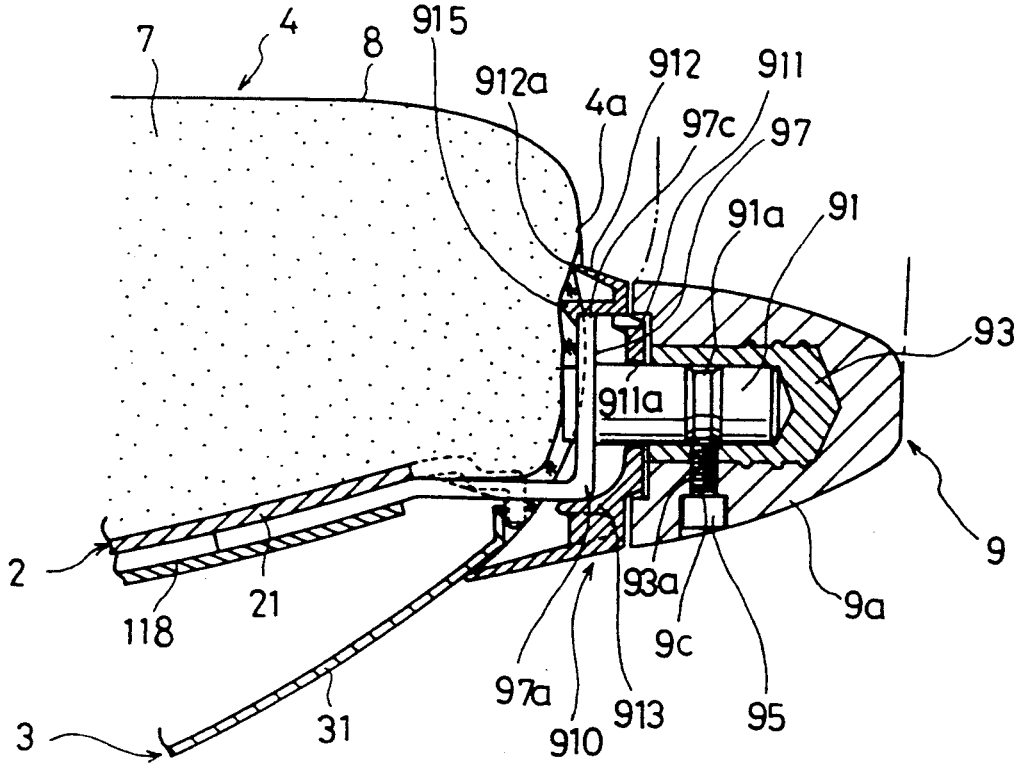

Covers 910 and 920 are provided on the bent portions 97 and 98 to cover them. In particular, as shown in FIG. 36, the covers 910 and 920 comprise a body 911, 921 integrally made of synthetic resin and attached to the outer surface of the bent portion 97, 98 and having a through bore 911*a*, 921*a* for the shaft 91, 92 to pass through, and a cylindrical portion 912, 922 projecting from the circumference of the body 911, 921 so as to enclose the bent portion 97, 98 and having an open edge 912*a*, 922*a* resiliently urged against the side surface 4*a* of the seat 4 and the side surface of the backrest 5. The covers 910 and 920 are mounted on the bent portions 97 and 98 by claws. In particular, receiving members 913 and 923 for holding the corners 97*a* and 98*a* of the bent portions 97 and 98, a pair of engaging claws 914 and 924 engageable with both edges 97*b* and 98*b* of the bent portions 97 and 98, and engaging claws 915 and 925 engageable with the tip ends 97*c* and 98*c* of the bent portions 97 and 98 project from the inner surfaces of the cover bodies 911 and 921. By urging the cover bodies 911 and 921 against the outer surfaces of the bent portions 97 and 98 all of the engaging claws 914, 915, 924 and 925 are temporarily deformed resiliently, so that these claws engage the inner surfaces of the bent portions 97 and 98.

The armrests 9 are C-shaped in cross section and can function as a spring having a relatively strong repellent force. In particular, the armrests 9 may be so formed that the distance between the bearings 93 and 94 provided on both ends 9a and 9b thereof is shorter than that between the shafts 91 and 92 at the reference position a, and the armrests 9 are urged so as to be connected to the shafts 91 and 92. Then the seat bracket 118 and the backrest bracket 119 are resiliently deformed toward each other due to the resilient force of the armrests 9. Thus, it is possible to make the armrests 9 function as an auxiliary spring for the spring 115 which may be of a smaller size or as a substitute for the spring 115.

How the chair works will be now described.

In the reference position a shown in FIG. 1 and in real line in FIG. 2, the backrest 5 stands upright and the seat 4 is held at its rearmost position. This reference position a is suitable for desk work. As a user pushes the backrest 5 rearwardly of the reference position a with his back, the balancing members 101 with the backrest 5 are pivoted rearwardly about the shaft 102 as a fulcrum. As a result, the front ends of the balancing members 101 are lifted, and the front link members 106 are pivoted forwardly, so that the seat receiving frame 105 is moved forwardly, and the rear link members 107 supported on the rear ends of the balancing members 101 are pivoted forwardly. At this time, since the degree of descent of the whole rear link members 107 upon inclination of the balancing members 101 is greater than the degree of ascent of the shaft 111 at the upper pivot points of the rear link members 107 upon rotation thereof, apparently the seat 4 is moved forwardly with the rear end thereof gradually descending to reach a middle position b shown in dash-and-double-dot line in FIG. 2, where the rearward inclination of the backrest support 104 reaches its limit. When the backrest 5 is further pushed rearwardly from the above-mentioned position, the upper portion 5a of the backrest 5 is rearwardly inclined relative to the lower portion 5b thereof. At a rest position c shown in broken line in FIG. 2 the rearward pushing force balances the resilient force of the backrest 5.

Figure 15:
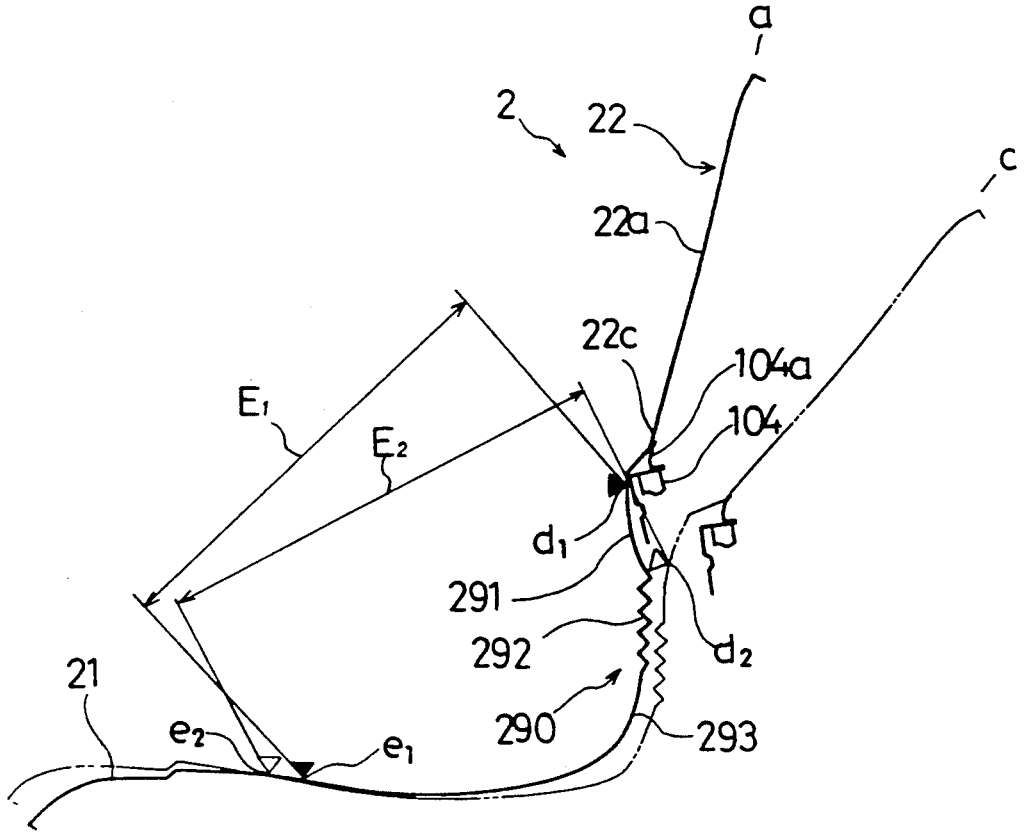

The above-mentioned motions will further be described with particular reference to the inner shell 2 and the outer shell 3. First, in the region between the reference position a and the middle position b, the deformation of the border portion 28 of the inner shell 2 and the border portion 34 of the outer shell 3 chiefly causes rearward inclination of the backrest portions 22 and 23. In the region between the middle position b and the rest position c, the upper portion 22a of the backrest portion 22 is inclined rearwardly on a fulcrum near the upper end of the backrest support 104. In this case, the inner shell 2 functions as a plate spring due to the slits 29 and deforms rearwardly while keeping resiliency, and the outer shell 3 is resiliently deformed rearwardly while being displaced downwardly relative to the inner shell 2. In particular, since the upward claws 301 and the inward claws 302 and 303 of the outer shell 3 engage the corresponding engaging holes 201, 202 and 203 so as to be movable up and down relative thereto, the outer shell 3 can be inclined rearwardly while resiliently supporting the inner shell 2. When the upper portion 22a of the inner shell 2 is rearwardly inclined relative to the lower portion 22b thereof, the curved portion 291 of the belt member 290 provided near the base portion 22c for rearward inclination of the inner shell 2 projects forwardly relative to the lower portion 22b thereof. In particular, the curved portion 291 is connected to the upper portion 22a in reinforced condition, and the rear surface of the connected portion is supported by the supporting member 104a fixed to the upper end portion of the backrest support 104, so that if the upper portion 22a of the inner shell 2 is inclined rearwardly, the upper portion 22a and the curved portion 291 are moved like a seesaw on the above-mentioned support member 104a as a fulcrum, so that the curved portion 291 projects forwardly. As a result, the backrest point d set near the foremost portion of the curved portion 291 is moved from the upper to the lower end portion of the curved portion 291. Therefore, as shown in FIG. 15 the distance $E_1$ between a sitting reference point $e_1$ and a backrest point $d_1$ in the reference position a and the distance $E_2$ between a sitting reference point $e_2$ and a backrest point $d_2$ in the rest position c can be maintained as nearly equal as possible. In the above description, for the purpose of easy understanding of the operation a middle position b where the backrest support 104 is inclined to the maximum without deformation of the backrest portions 22 and 23 of the inner shell 2 and the outer shell 3 is supposed to exist. In practical use, however, as the user pushes the backrest, the inner shell 2 and the outer shell 3 are resiliently deformed with rearward inclination of the backrest support 104 and the backrest 5, so that the deformation of the shells 2 and 3 continuously takes place from the reference position a to the rest position c. Thus, the backrest point d is also continuously shifted downwardly, so that it is possible to maintain the distance E between the sitting reference point e and the backrest point d approximately equal at all times. Thus, it is possible to eliminate the disadvantage that upon rearward inclination of the backrest 5 the backrest point d is improperly shifted upwardly so as to make the user feel uncomfortable. Even if the backrest 5 is repeatedly inclined rearwardly and returned to the upright position, the shirt of the user will not be pulled up.

In this chair with a backrest, since the three-dimensional shell structure comprising the seat portions 21 and 31 and the backrest portions 22 and 32 of the inner and outer shells 2 and 3 provide a strength for maintaining the whole contour of the seat 4 and the backrest 5, it is possible to set the strength, easiness of deformation, and resilient force of the components within a wide range by suitably selecting the degree of curvature of both the shells 2 and 3, the range of allowable relative shifting between the shells 2 and 3, and the distance the shells 2 and 3 can approach toward each other.

If it is desirable to adjust the reference position a and the rest position c, a mechanism as shown in FIGS. 42 to 45 may be provided. In the arrangement shown in FIGS. 42 to 44, each front link member 106 is supported by an eccentric portion 741 of a shaft 704 received by the supporting base 13, and the fixed position of the shaft 704 in the direction of rotation can be changed by an eccentric position regulator 705. The shaft 704 comprises a square bar 742 to the opposite ends of which the eccentric portions 741 are fixed for simultaneous rotation therewith. The front link member 106 is rotatably mounted on the outer circumferential surface of each of the eccentric portions 741. The eccentric position regulator 705 comprises a pinion 751 fixed to the square bar 742 for simultaneous rotation therewith, a worm gear 752 meshing with the pinion 751, and an operating knob 753 fixed to the tip end of the shaft of the worm gear 752. With this arrangement, when the worm gear 752 is rotated by manipulating the operating knob 753, the eccentric portions 741 are rotated by the square bar 742, so that the pivot positions of the front link members 106 relative to the supporting base 13 are shifted. Thus it is possible to change the reference position a by regulating the stopped position of the seat 4 and the backrest 5. On the other hand, in the embodiment shown in FIG. 45, a threaded hole 13*e* is formed in an extension 13*c* of the supporting base 13, and a bolt 802 having a grip 801 inserted into the threaded hole 13*e*, so that the tip end of the bolt 802 abuts on a shaft 112 passed through the balancing members 101. With this arrangement, by regulating the vertical position of the bolt 802 by rotating the grip 801, it is possible to change the stopped position of the seat 4 and the backrest 5, thereby to change the rest position c.

Figure 46:
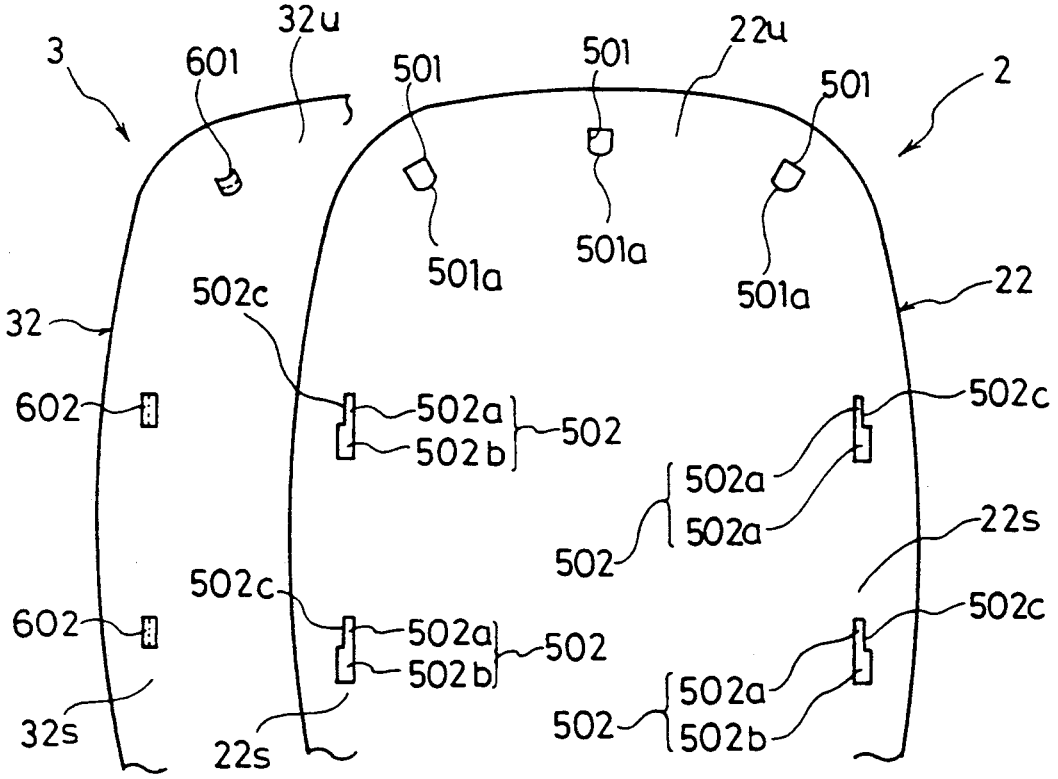
Figure 47:
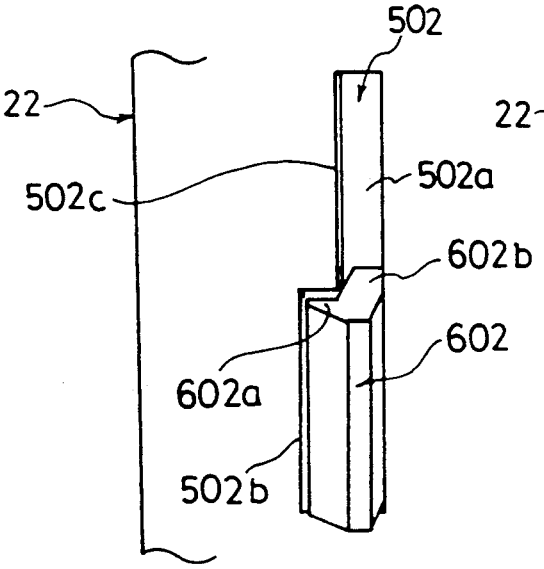
Figure 48:
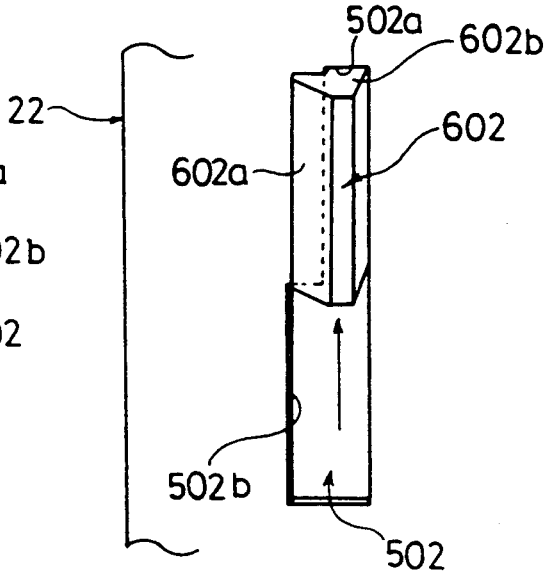

A different arrangement for connecting the backrest portion of the inner shell and the backrest portion of the outer shell is shown in FIGS. 46 to 48. In this construction for connection, a plurality of first engaging holes 501 are provided in the upper periphery portion 22*u* of the backrest portion 22 of the inner shell 2, and a plurality of downward claws 601 are provided adjacent the upper peripheral portion 32*u* of the backrest portion 32 of the outer shell 3. These engaging holes 501 and the downward claws 601 can be sililar to those in the above-mentioned embodiment. On the other hand, second engaging holes 502 are provided adjacent both the lateral edge portions 22*s* of the backrest portion 22 of the inner shell 2, and outward claws 602 are provided adjacent both the lateral edge portions 32*c* of the backrest portion 32 of the outer shell 3. The second engaging holes 502 comprise two half portions the upper portion 502*a* of which is narrower than the lower portion 502*b* and extends in vertical direction. The outward claws 602 are of such a shape and dimension that the head 602*a* can pass through the lower half portion 502*b* of the second engaging hole 502 and the base portion 602*b* can engage the upper half portion 502*a* of the second engaging hole 502 without a substantial clearance between them. The claws 602 have an undercut portion on the outer side thereof.

First, as shown in FIG. 47 the outward claw 602 is inserted in the lower half portion 502*b* of the second engaging hole 502. Then, the backrest portion 32 of the outer shell 3 is shifted upwardly relative to the backrest portion 22 of the inner shell 2 so as to cause the outward claw 602 to slide into the upper half portion 502*a* of the second engaging hole 502. This causes the outward claw 602 to engage the outer edge 502*c* of the second engaging hole 502. Under the condition, each downward claw 601 enages the lower edge 501*a* of the corresponding first engaging hole 501 by resilient deformation of each member. Under the condition that the downward claws 601 engage the first engaging holes 501, even if the outer shell 3 should be displaced downwardly within a required range relative to the inner shell 2 upon rearward inclination of the backrest 5, a part of each outward claw 602 must be positioned in the narrow upper half portion 502*a* of the second engaging hole 502. For this reason, the disadvantage that the outward claws 602 are disengaged from the second engaging holes 502 while in use is eliminated without losing a suitable resiliency of the backrest 5.

Figure 49:
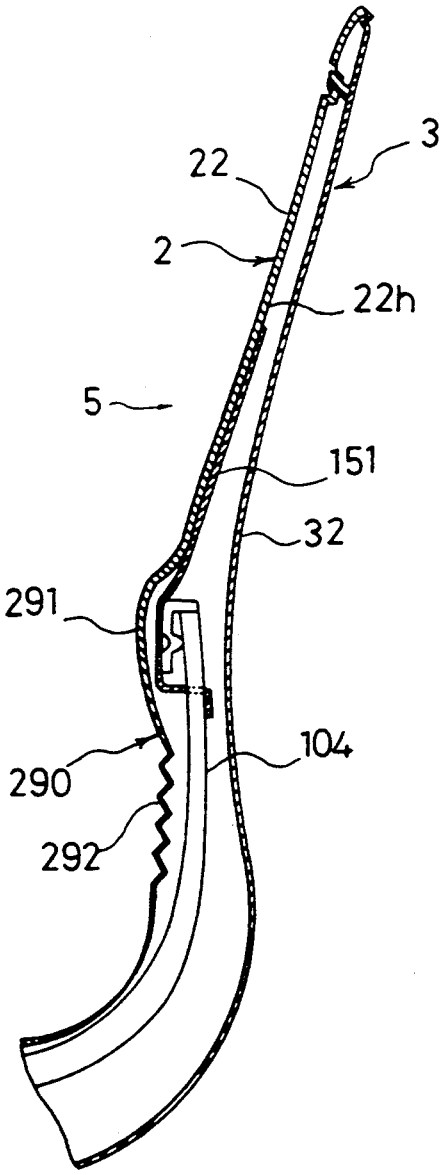

FIG. 49 shows an embodiment in which a resilient plate-like member 151 extends upwardly from the upper end of the backrest support 104, and the rear surface 22*h* of the backrest portion 22 of the inner shell 2 is supported by the resilient plate-like member 151. The parts which are the same as or correspond to those in the above-mentioned embodiments are designated by the same reference symbols, and no description of those parts will be given as in the following embodiments.

Figure 50:
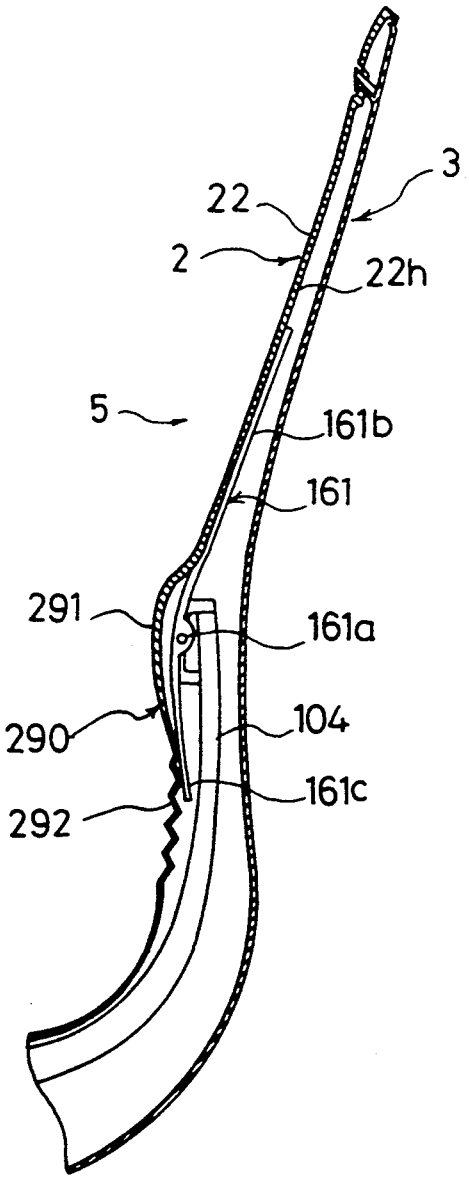

FIG. 50 shows another embodiment in which the lower part of a resilient plate-like member 161 is pivotally mounted on the upper end portion of the backrest support 104, and that portion 161*b* of the resilient plate-like member 161 which is above the pivot 161*a* thereof bears against the rear surface 22*h* of the inner shell 2, so that when the upper portion 22*a* of the inner shell 2 is rearwardly inclined, the lower power 161*c* of the resilient plate-like member 161 is forwardly moved to push the pad 7 in contact with surface of the inner shell 2. In this embodiment, the lower portion 161*c* of the resilient plate-like member 161 contacts the rear surface of the bellows 292 of the belt member 290 and pushes the pad 7 forwardly indirectly through the bellows 292.

Figure 51:
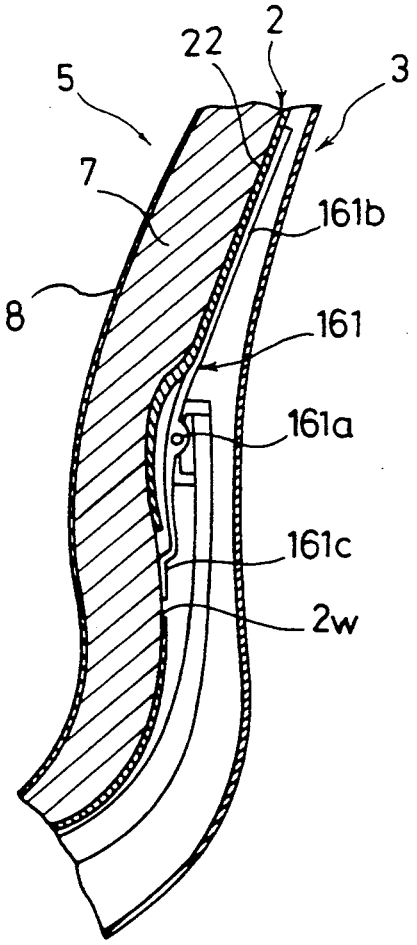

FIG. 51 shows another embodiment in which the lower portion 161*c* of the resilient plate-like member 161 pushes the pad 7 forwardly. In this embodiment, a through hole 2*w* is formed in the inner shell 2, and the lower end portion 161*c* of the resilient plate-like member 161 is bent and inserted into the through hole 2*w*, so that the bent lower end portion 161*c* pushes the pad 7 forwardly.

Figure 52:
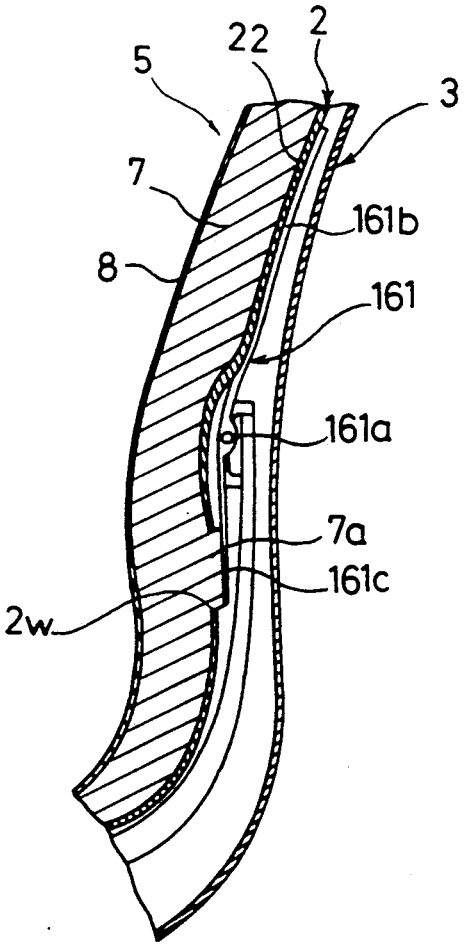

FIG. 52 shows still another embodiment in which the lower end portion 161*c* of the resilient plate-like member 161 pushes the pad 7 forwardly. In the embodiment, a through hole 2*w* is formed in the inner shell 2, and a portion of the pad protrudes through the through hole 2*w*, so that the lower end portion 161*c* of the resilient plate-like member 161 directly pushes the protruding portion 7*a* of the pad 7 forwardly.

POSSIBILITY OF INDUSTRIAL APPLICATION

The chair provided with a backrest in accordance with the invention is a suitable one for use in offices, and is particularly useful as a chair in which one can take both a working position and a rest position.

We claim:

1. A chair provided with a backrest (5) and a seat (4) and characterized by the provision of an inner shell (2) L-shaped in side view and comprising a seat portion (21) and a backrest portion (22) formed into an integral body, and an outer shell (3) L-shaped in side view and comprising a seat portion (31) and a backrest portion (32) formed into a integral body, the outer shell (3) being fixed to the inner shell (2) in such a manner that not all surfaces of the shells contact each other; the outer shell being supported by the inner shell only and having an opening (33) through the seat portion (31) thereof; the opening (33) providing clearance between outer shell (3) and a supporting unit (1) extending though opening (33) of the outer shell (3) and into supporting contact with the seat portion (21) of the inner shell (2).

2. The chair provided with a backrest decribed in claim 1 and characterized by a fixed shell (6) being fixed to a supporting unit (1) and moveable relative to the outer shell (3) such that fixed shell (6) and supporting unit (1) cover the opening (33) during relative movement between supporting unit (1) and outer shell (3).

3. The chair provided with a backrest (5) and seat (4) described in claim 2, in which the supporting unit (1) is provided with a column (12) standing on a base (11) and a supporting base (13) fixed on the upper end of the column (12), and characterized by the supporting base (13) being provided with at least four downwardly projecting pins ($14_1 \sim 14_6$) serving to maintain a space between the fixed shell (6) and the supporting base (13), and the fixed shell (6) being fixed to the supporting base (13) at at least one point in a middle portion of said fixed shell (6) by means of bolts (66).

4. The chair provided with a backrest (5) and seat (4) described in claim 2 and characterized by having a front wall (63) and the rear wall (64) of the fixed shell (6) so contoured as to approximately conform to corresponding loci described by a front edge (33*b*) and a rear edge (33*c*) of the opening (33), respectively, as the outer shell (3) is moved relative to the supporting unit (1).

5. The chair provided with a backrest (5) and seat (4) described in claim 1 and characterized by the outer shell (3) being detachably mounted on the inner shell (2), and a fixed shell (6) being detachably fixed to the supporting unit (1), and a manual controller (120) and a mechanism (121) to be operated by the manual controller (120) being provided on the inner shell (2) and the supporting unit (1) and independently of the outer shell (3) and the fixed shell (6).

6. The chair provided with a backrest (5) and seat (4) described in claim 5, in which the machanism (121) is provided in a supporting base (13) supporting the seat (4), and the manual controller (120) is provided outside the supporting base (13), with a transmission wire (127) comprising a wire (129) slidably passing through a guide tube (128) being used for tramsmitting an operation applied to the controller (120) to the mechanism (121) through the transmission wire (127), and characterized by one end of the guide tube (128) being held in the supporting base (13) and being nonadjustable in position, and another end of the guide tube (128) being held on an under surface of the inner shell (2) outside the supporting base (13) and being adjustable in position.

7. Thge chair provided with a backrest (5) and seat (4) described in claim 1 and characterized by a backrest support (104) extending from the supporting unit (1) and comprising a pair of solid square metallic bars (141) laterally spaced apart from each other, with lower ends of the solid square bars (141) being connected together by a connecting member (103) welded thereto, and a bracket (119) having a bent portion (119*d*) placed on tip end surfaces (141*c*) of end portions (141*b*) of the solid square bars (141), with at least three sides of each tip end surface (141*c*) being attached to an under surface of the bent portion (119*d*) by welding.

8. A chair provided with a backrest (5) and seat (4) and characterized by the provision of an inner shell (2) L-shaped in side view and comprising a seat portion (21) and a backrest portion (22) formed into an integral body, and an outer shell (3) L-shaped in side view and comprising a seat portion (31) and a backrest portion (32) formed into a integral body, the outer shell (3) being fixed to the inner shell (2) in such a manner that not all surfaces of the shells contact each other, an upper backrest portion (5*a*) being resiliently inclinable relative to a lower backrest portion (5*b*), and means for connecting the backrest portion (22) of the inner shell (2) and the backrest portion (32) of the outer shell (3) at side edge portions (22*s*, 32*s*) so as to accommodate vertical displacement of the shells (2, 3) relative to each other and to accommodate the resilient inclination of the upper portion (5*a*) of the backrest (5) relative to the lower portion (5*b*) thereof as a user leans against the backrest (5).

9. The chair provided with a backrest (5) and seat (4) described in claim 8, which a plurality of engaging holes (202, 203, 204) are provided in the side edge portions (22*s*) and an upper edge portion (22*u*) of the backrest portion (22) of the inner shell (2), and a plurality of inward claws (302, 303) and downward claws (304) are provided on the side edge portions (32*s*) and an upper edge portion (32*u*), respectively, of the backrest portion (32) of the outer shell (3), and the inward claws (302, 303) and the downward claws (304) are inserted into the corresponding engaging holes (202, 203, 204) so as to engage inner side edges (202*a*, 203*a*) and lower side edges (204*a*) thereof, respectively, by resilient deformatiion of each member; and characterized by the inner side edges (202*a*) of the engaging holes (202) formed in the side edge portions (22*s*) of the backrest portion (22) being linear, and the inward claws (302) engaging the inner side edges of the engaging holes (202) being moveable relatively in upward and downward directions, and projecting tongues (202*c*) being deformable in a direction of the thickness and being formed integrally on outer side edges (202*b*) of the engaging holes (202), with free ends (202*d*) of tongues (202*c*) contacting outer surfaces of the inward claws (302) engaging the inner side edges (202*a*).

10. The chair provided with a backrest (5) and seat (4) described in claim 8 and characterized by a plurality of first engaging holes (501) being provided in the upper edge portion (22*u*) of the backrest portion (22) of the inner shell, a plurality of downward claws (601) being formed integrally on the upper edge portion (32*u*) of the backrest portion (22) of the outer shell (3), a plurality of vertically extending second engaging holes (502), with upper half portions (502*a*) narrower in width than lower portions (502*b*) thereof, being formed in both the side edge portions (22*s*) of the backrest portion (22) of the inner shell (2), and outward claws (602), heads (602*a*) of which can pass through the lower half portions (502*b*) of the second engaging holes (502) and main portions (602*b*) of which tightly engage the upper portions (502*a*) of the second engaging holes (502), being formed on both side portions (32*s*) of the backrest portion (32) of the outer shell (3) so as to project therefrom, and the outward claws (602) being inserted through the lower half portions (502*b*) of the second engaging holes (502) so as to engage outer edges (502*c*) of the upper half portions (502*a*), and having each downward claw (601) engaging a lower edge (501*a*) of each corresponding first engaging hole (501) by resilient deformation of each member.

11. The chair provided with a backrest (5) and seat (4) described in claim 8 and characterized by a backrest support (104) being enclosed between the inner shell (2) and the outer shell (3), and an upper portion (22*a*) of the inner shell (2) being rearwardly inclinable at a fulcrum near an upper end of the backrest support (104).

12. The chair provided with a backrest (5) and seat (4) described in claim 11 and characterized by the backrest portion (22) of the inner shell (2) being so curved that right and left side edges (22*s*) thereof are positioned forwardly of a middle portion thereof, and near the middle portion are formed slits (29) directed crosswise of a horizontally extending bracket (119) fixed on the upper end of the backrest support (104), and only both the side edge portions (22s) of the inner shell (2) being fixed to the bracket (119) by connectors (27).

13. The chair provided with a backrest (5) and seat (4) decribed in claim 8, in which the upper portion (22a) of the backreat portion (22) of the inner shell (2) is rearwardly inclinable relative to the lower portion (22b) thereof, and characterized by a resilient belt member (290) connecting a portion near the base (22c) of rearward inclination of the backrest portion (22) to the rear end of the seat portion (21) of the inner shell (2), and a narrow curved portion (291) of belt member (290) forwardly protruding a short distance from backrest portion (22) and being formed at the connection portion of the backrest portion (22) to the belt member (290), and when the upper portion (5a) of the backrest portion (5) is rearwardly inclined relative to the lower portion (5b) thereof, the curved portion (291) can protrude forwardly of the lower portion (5b) of the backrest portion (5).

14. The chair provided with a backrest (5) and seat (4) described in claim 13 and characterized by two vertically extending slits (29) being provided in the inner shell (2), so that the belt member (290) is formed between the slits (29).

15. The chair provided with a backrest (5) and seat (4) decribed in claim 13 and characterized by a resilient plate-like member (151) projecting upwardly from a tip end of the backrest support (104), and a rear surface of the inner shell (2) being supported by the resilient plate-like member (151).

16. The chair provided with a backrest (5) and seat (4) described in claim 13 and characterized by a resilient plate-like member (161) connected to the tip end of the backrest support (104) so as to be pivotable in forward and rearward directions about a pivot point (161a), and a portion of the resilient plate-like member (161) which is situated above the pivot point (161a) contacting an upper rear surface (22h) of the inner shell (2), such that when the upper portion (22a) of the inner shell (2) is rearwardly inclined, a lower end portion of the resilient plate-like member (161) protrudes forwardly so as to push a pad (7), attached to the surface of the inner shell (2). forwardly.

17. A chair provided with a backrest (5) and seat (4) characterized by the provision of an inner shell (2) L-shaped in side view and comprising a set portion (21) and a backrest portion (22) formed into an integral body, and an outer shell (3) L-shaped in side view and comprising a seat portion (31) and backrest portion (32) formed into a integral body, the outer shell (3) being fixed to the inner shell (2) in such a manner that not all surfaces of the shells contact each other, an upper backrest portion (5a) being resiliently inclinable relative to a lower backrest portion (5b), and a plurality of pins (251, 252, 253, 254) being provided on an under surface of seat portion (21) of inner shell (2) and projecting approximately perpendiculary to an imaginary plane (P) extending between a front edge (4t) of a seat (4) and an upper edge (5t) of a backrest (5), with axes (R) of the pins (251, 252, 253, 254) extending parallel with each other, and on an upper surface of the seat portion (31) of the outer shell (3) at the positions corresponding to the pins (251, 252, 253, 254) are provided a plurality of hollow cylindrical portions (351, 352, 353, 354) projecting in axial alignment with the pins (251, 252, 253, 254), with axes (T) of the hollow cylindical portions (351, 352, 353, 354) coinciding with the axes (R) of the pins (251, 252, 253, 254), so that the outer shell (3) is connected to the inner shell (2) by inserting each of the pins (251, 252, 253, 254) into a corresponding one of the hollow cylindrical portions (351, 352, 353, 354), and the outer shell (3) is fixed to the inner shell (2) by means of bolts (355) screwed thereinto in a direction axially aligned or parallel with axes (R, T).

18. A chair provided with a backrest (5) and seat (4) and characterized by the provision of an inner shell (2) L-shaped in side view and comprising a seat portion (21) and a backrest portion (22) formed into an integral body, and an outer shell (3) L-shaped in side view and comprising a seat portion (31) and a backrest portion (32) formed into a integral body, the outer shell (3) being fixed to the inner shell (2) in such a manner that not all surfaces of the shells contact each other, an upper backrest portion (5a) being resiliently inclinable relative to a lower backrest portion (5b), and in which an upholstery (8) covers an upper surface (2j) of the inner shell (2) with a pad (7) interposed therebetween, and means for preventing the pad (7) from sliding on an upper surface (2j) of the inner shell (2) and comprising a projection (200) projecting upwardly aslant into the pad (7) at least on a front edge of the seat portion (21) of the inner shell (2).

19. A chair provided with a backrest (5) and seat (4) and characterized by the provision of an inner shell (2) L-shaped in side view and comprising a seat portion (21) and a backrest portion (22) formed into an integral body, and an outer shell (3) L-shaped in side view and comprising a seat portion (31) and a backrest portion (32) formed into integral body, the outer shell (3) being fixed to the inner shell (2) in such a manner that not all surfaces of the shells contact each other, an upper backrest portion (5a) being resiliently inclinable relative to a lower backrest portion (5b), and a continuous brim (210) extending downwardly and rearwardly from an outer circumferential edge of the inner shell (2), and a continuous brim (310) extending upwardly and forwardly from an outer circumferential edge of the outer shell (3), and the brim (310) on the outer shell (3) being situated inside and substantially parallel with the brim (210) on the inner shell (2).

20. The chair provided with a backrest (5) and seat (4) described in claim 19 and characterized by an upholstery (8) covering upper and front surfaces of the inner shell (2), with a pad (7) interposed therebetween, and a peripheral portion of the upholstery (8) passing through a gap between the brim (210) of the inner shell (2) and the brim (310) of the outer shell (3) to an under surface and a rear surface of the inner shell (2), and fixed to the inner shell (2).

21. The chair provided with a backrest (5) and seat (4) described in claim 19 and characterized by a dimension (W) of protrusion of the brim (210) of the inner shell (2) in the border portion between the seat (4) and the backrest (5) being greater than in other portions of the brim 210.

22. A chair as in claim 21, wherein the peripheral portion (8a) of the upholstery (8) is inturned over the brim (210) of the inner shell (2) on an under surface (2k) and a back surface (2h) of the inner shell (2) and fixed thereto by means of tacks 81, with the brim 310 of the outer shell 3 pressing the inturned peripheral portion (8a) onto the inner shell (2).

23. A chair provided with a backrest (5) and seat (4) and characterized by the provision of an inner shell (2) L-shaped in side view and comprising a seat portion

(21) and a backrest portion (22) formed into an integral body, and an outer shell (3) L-shaped in side view and comprising a seat portion (31) and a backrest portion (32) formed into a integral body, the outer shell (3) being fixed to the inner shell (2) in such a manner that not all surfaces of the shells contact each other, an upper backrest portion (5*a*) being resiliently inclinable relative to a lower backrest portion (5*b*), and the seat portion (21) of the inner shell (2) being fixed to one seat bracket (118) provided on a supporting unit (1) for supporting the seat (4), and the backrest portion (22) of the inner shell (2) being fixed to a backrest bracket (119) of a backrest support (104) extending from the support unit (1) , and the inner shell (2) not being fixed to the supporting unit (1) between the seat bracket (118) and backrest bracket (119).

24. The chair provided with a backrest (5) and seat (4) described in claim 23 and characterized by a shaft (91, 92) being provided on each opposite end of each of the bracket (118, 119) so as to project sideways, and a bearing (93, 94) being embedded in each end of each of a pair of resiliently deformable inverted L-shaped armrests (9), so that the bearings (93) on front ends of the armrests (9) are supported by the shafts (91) on the seat bracket (118), and the bearings (94) on the rear ends of the armrests (9) are supported by the shafts (92) on the backrest bracket (119) .

25. The chair provided with a backrest (5) and seat (4) described in claim 24 and characterized by provision of a circumferential engaging groove (91*a*, 92*a*) being formed on each of the shafts (91, 92) of both the brackets (118, 119), and a radial threaded hole (93*a*, 93*b* ) being formed in each of the bearings (93, 94) which are embedded in the ends (9*a*, 9*b*) of both of the armrests (9). and a tip of an engaging bolt (95, 96) screwed into each of the threaded holes (93*a*, 94*a* ) being inserted into the circumferential groove (91*a*, 92*a* ) of each of the shafts (91, 92).

26. The chair provided with a backrest (5) and seat (4) described in claim 24 and characterized by the armrests (9) being resilient and the seat bracket (118) being spaced from the backrest bracket (119) such that the brackets (118, 119) are urged toward each other by resiliency of the armrests (9).

27. A chair provided with a backrest (5) and seat (4) and characterized by the provision of an inner shell (2) L-shaped in side view and comprising a seat portion (21) and a backrest portion (22) formed into an integral body, and an outer shell (3) L-shaped in side view and comprising a seat portion (31) and a backrest portion (32) formed into a integral body, the outer shell (3) being fixed to the inner shell (2) in such a manner that not all surfaces of the shells contact each other, an upper backrest portion (5*a*) being resiliently inclinable relative to a lower backrest portion (5*b*), and balancing member (101), from a rear end of which extends a backrest support (104) for the supporting the backrest portion (22) of the inner shell (2), being pivotally mounted at middle portions thereof to a supporting base (13) by a middle shaft (102), and front end portions of the balancing members (101) being connected to a front end portion of a seat receiving frame (105), supporting the seat portion (21) of the inner shell (2), by front link members (106) pivotally mounted on the supporting base (13) with a rear end portion of the seat receiving frame (105) being connected to rear ends of the balancing members (101) by rear link members (107) so as to be movable in forward and rearward directions, so that upward movement of the front end portions of the balancing members (101) upon rearward inclination of the backrest (5) is translatable into a forward movement of seat receiving frame (105), through the front link members (106).

28. The chair provided with a backrest (5) and seat (4) described in claim 27, in which a pair of right and left balancing members (101) are provided, and characterized by the seat receiving frame (105) being made of a frame member extending in forward and rearward directions, and a boss (107*a*, 107*b*) of a required axial length (Wa, Wb) being formed on at least one of the upper and lower ends of each of the rear link members (107), and the rear link members (107) being connected to the seat receiving frame (105) by a shaft (111) passing through upper ends of the rear link members (107), and to the balancing members (101) by a shaft (112) passing through lower ends of the rear link members (107).

29. The chair provided with a backrest (5) and seat (4) described in claim 27 and characterized by a front end portion of each balancing member (101) being provided with a slot (113) in which a pin (110) projecting from each front link member (106) slidably engages, so that abutment of the pin (110) on a front edge (113*a*) of the slot (113) prevents further forward inclination of the backrest (5) and further rearward movement of the seat (4).

30. The chair provided with a backrest (5) and seat (4) described in claim 29 and characterized by the front link members (106) being rotatably supported by the eccentric portions (741) of a shaft (704) received by the supporting base (13), and a fixed position of the shaft (704) in a direction of rotation thereof is made adjustable by means of an eccentric position adjusting mechanism (705).

31. The chair provided with a backrest (5) and seat (4) described in claim 27 and characterized by a bottom wall (13*a*) of the supporting base (13) extending to the vicinity of the rear ends of the balancing members (101), and a shaft (112) fixed to the rear ends of the balancing members (101) being positioned adjacent an extension (13*c*) of the supporting base (13), so that the shaft (112) abuts on the extension (13*c*) of the supporting base (13), thereby to prevent further rearward inclination of the backrest (5) and further forward movement of the seat (4).

32. The chair provided with a backrest (5) and seat (4) described in claim 31 and characterized by a threaded through hole (13*e*) being formed in and nearly perpendicular to the extension (13*c*), with a bolt (802) having a grip (801) at a bottom end thereof engaging the threaded hole (13*e*), so that the shaft (112) may be stopped by a tip end of the bolt (802).

33. The chair provided with a backrest (5) and seat (4) described in claim 27 and characterized by the middle shaft (102) supporting the balancing members (101) being used also as a shaft for supporting a rotatable arm (126) in a height adjusting mechanism.

34. A chair provided with a backrest (5) and a seat (4) and characterized by an inner shell (2) L-shaped in side view and comprising a seat portion (21) and a backrest portion (22) formed into an integral body, and an outer shell (3) L-shaped in side view and comprising a seat portion (31) and a backrest portion (32) formed into a integral body, the outer shell (3) being fixed to the inner shell (2) in such a manner that not all surfaces of the shell contact each other, said inner shell having means provided therin for flexible tilting of said backrest relative to said seat, outer peripheral edges of the inner shell (2) and outer shell (3) being much the same shape and a space being provided between the outer peripheral edges of the inner shell (2) and the outer shell (3), an upholstery (8) covering an upper surface of the inner shell (2), a pad (7) interposed between the upholstery (8) and inner shell (2), and a peripheral portion (8*a*) of the upholstery (8) being fitted into the space between the outer peripheral edges of the inner and outer shells (2, 3).

35. A chair as in claim 34, and further comprising a backrest supporting member (104) interposed between the inner shell (2) and the outer shell (3).

36. A chair as in claim 34, and further comprising a support unit (1) and means, operatively associated therewith, for providing that the seat (4) is inclinable relative to the supporting unit (1).

* * * * *